United States Patent [19]

Sato et al.

[11] Patent Number: 4,880,730

[45] Date of Patent: Nov. 14, 1989

[54] SILVER HALIDE LIGHT-SENSITIVE MATERIAL

[75] Inventors: Kozo Sato; Yoshisada Nakamura, both of Kanagawa, Japan

[73] Assignee: Fuji Photo Film Co., Ltd., Kanagawa, Japan

[21] Appl. No.: 280,412

[22] Filed: Dec. 6, 1988

[30] Foreign Application Priority Data

Dec. 7, 1987 [JP] Japan ..... 62-309344

[51] Int. Cl.[4] ..... G03C 1/84

[52] U.S. Cl. ..... 430/520; 430/510; 430/517; 430/523; 430/524

[58] Field of Search ..... 430/510, 517, 520, 524, 430/523

[56] References Cited

U.S. PATENT DOCUMENTS 4,201,590 5/1980 Levinson et al. ..... 430/517

4,376,162 3/1983 Kawata et al. ..... 430/510

*Primary Examiner*—Paul R. Michl

*Assistant Examiner*—Hoa V. Le

*Attorney, Agent, or Firm*—Sughrue, Mion, Zinn, Macpeak & Seas

[57] ABSTRACT

A silver halide photographic light-sensitive material comprising a support having thereon at least one colored layer, and the layer can be decolored or lightened upon photographic processing of the photographic light-sensitive material, wherein the colored layer is formed by a process comprising the step of:

color developing at least one colorless or light-colored leuco-dyestuff utilizing at least one metal salt of an organic acid.

10 Claims, No Drawings

SILVER HALIDE LIGHT-SENSITIVE MATERIAL

FIELD OF THE INVENTION

The present invention relates to a silver halide photographic light-sensitive material which has a colored hydrophilic colloid layer. Further, it relates to a silver halide photographic light-sensitive material which has a hydrophilic colloid layer comprising a colored composition which, as well as being photographically chemically inert, is readily decolored by a novel mechanism in the photographic treatment process.

BACKGROUND OF THE INVENTION

In a silver halide photographic light-sensitive material, the silver halide emulsion layer or some other layer is often colored for the purpose of absorbing light of a specific wavelength.

For example, in situations where it is necessary to control the spectral composition of the light incident at a silver halide emulsion layer, a colored layer is provided on the side of the emulsion layer on the photographic light-sensitive material that is away from the base. This kind of colored layer is called a filter layer (U.S. Pat. Nos. 2,527,583, 2,952,566, etc.).

In the case where there are a plurality of photographic emulsion layers such as in a multilayer color light-sensitive material, filter layers may be positioned between them.

Further, to prevent image blurring, i.e., "halation", a colored layer is provided between the emulsion layer and the base, or at the surface of the base opposite the emulsion layer. Halation occurs due to light scattering resulting from light passing through the emulsion layer or occurs after transmission from light being reflected at the interface between the emulsion layer and base, or at the surface of the light-sensitive material on the opposite side to the emulsion layer, and then again entering the emulsion layer. Such a colored layer is called an antihalation layer. In the case of a multi-layer color light-sensitive material, antihalation layers may be placed between the respective layers (U.S. Pat. Nos. 3,488,195, 3,575,704, etc.).

Moreover, in order to prevent a reduction in image sharpness due to scattering of the light in the emulsion layer (this phenomenon is generally called irradiation), the emulsion layer may be colored. Such colored emulsion layers are called "irradiation preventing layer" (U.S. Pat. No. 4,078,933, JP-B-51-46607) (the term "JP-B" as used herein means an "examined Japanese patent publication").

The layers colored in this way mostly comprise a hydrophilic colloid, and so normally a water soluble dye is incorporated into the layer to effect coloration. This dye needs to satisfy the following conditions.

(1) It must have an appropriate spectral absorption corresponding to the particular usage objectives.

(2) It must be photographically chemically inert. That is to say, there must be no adverse chemical effects on the performance of the silver halide photographic emulsion layer, such as a reduction in sensitivity, fading of the latent image or fogging.

(3) It must be decolored or lightened in the photographic treatment process, and there must be no residual color detrimental to the photographic light-sensitive material following treatment.

Considerable efforts have been made by those skilled in the art to discover dyes which meet these conditions.

Processed dyes include oxonol dyes having a pyrazolone or barbituric acid nucleus, oxonol dyes, azo dyes, azomethine dyes, arylidene dyes, styryl dyes, triarylmethane dyes, merocyanine dyes and cyanine dyes.

However, among these dyes there are some which have little effect on the photographic emulsion itself but in the case of a spectrally-sensitized emulsion have the disadvantage of lowering sensitivity due to desorption of the sensitizing dyestuff, as well as spectral sensitization to unnecessary regions.

Again, insufficient decoloration or lightening can occur following treatment, as a result of the speeding-up of the developing treatment carried out in recent years. In order to resolve this problem, the use of dyes that are highly reactive with bisulfite ion has been proposed. However, the use of such dyes results in an insufficiently stable photographic film. More specifically a reduction in image density occurs with the passage of time and thus the desired photographic effect is not obtained.

Furthermore, in methods which utilize such water-soluble dyes, it is not possible to completely prevent diffusion of the dye contained in a specific layer, into other layers. Therefore, adverse effects are often exerted on other layers, and thus a so-called "discrete-layer dyeing technique" is strongly desired.

It is well-known that a leuco-dyestuff added to a silver halide light-sensitive material will be oxidized upon development to produce a developed dyestuff. However, the concept of adding a leuco-dyestuff which has already been developed and then decoloring or lightening this at the time of the photographic processing treatment is totally unknown.

SUMMARY OF THE INVENTION

The object of the present invention is, firstly, to provide a silver halide photographic light-sensitive material having a colored hydrophilic colloid layer which is stable with the passage of time and exhibits outstanding decoloring characteristics at the time of the photographic processing treatment.

A second object of the present invention is to provide a silver halide photographic light-sensitive material which employs a novel technique that makes it possible to selectively color only the desired layer.

A third object of the invention is to provide a silver halide photographic light-sensitive material having a hydrophilic colloid layer which may be colored to include various colors so as to enable the absorption of light over a broad range extending across almost all of the visible region and near the infrared region.

A fourth object of the invention is to provide a silver halide photographic light-sensitive material exhibiting excellent desilvering properties.

A fifth object of the invention is to provide a photographic light-sensitive material exhibiting a high degree of sharpness.

A sixth object of the invention is to provide a color photographic light-sensitive material having excellent color reproducibility.

A seventh object of the invention is to provide a light-sensitive material which utilizes a small amount of silver.

These and other objects and effects of the present invention will be apparent from the following description.

The above objects of the present invention have been attained by a silver halide photographic light-sensitive material comprising a support having thereon at least one colored layer, and the layer can be decolored or lightened upon photographic processing of said photographic light-sensitive material, wherein the colored layer is formed by a process comprising the step of:

color developing at least one colorless or light-colored leuco-dyestuff utilizing at least one metal salt of an organic acid.

DETAILED DESCRIPTION OF THE INVENTION

The colorless or light-colored leuco-dyestuff employed in the present invention is not particularly restricted, and it is possible to use various compounds which include known materials.

Known leuco-dyestuffs are described in the following: Moriga and Yoshida "Senryo to Yakuhin (Dyestuffs and Chemicals)" 9, page 84 (Kaseihin Kogyo Kyokai, Japan 1964); "Shinpan Senryo Binran (New Dyestuffs Handbook)" page 242 (Maruzen, Japan 1970); R. Garner "Reports on the Progress of Appl. Chem." 56, page 199 (1971); and "Senryo to Yakuhin (Dyestuffs and Chemicals)" 19, page 230 (Kaseihin Kogyo Kyokai, Japan 1974), etc.

These leuco-dyestuffs are, in general, compounds which are developed by contact with an acidic developer. The use of these leuco-dyestuffs in the present invention is desirable.

Leuco-dyestuffs can be classified into a number of classes according to their structure. Examples of classes preferably employed in the present invention include diarylphthalide class, fluoran class, indolylphthalide, acylleucoazine class, leucoauramine class, spiropyrane, rhodamine lactam class, triarylmethane class and chromene class. Among these, diarylphthalide class, fluoran class and indolylphthalide class are more preferrrd.

The formulae of some typical examples of leuco-dyestuffs which can be used in the present invention are given below, classified by structural type. The hue of each example of leuco-dyestaff are laso given below.

| | | |
|---|---|---|
| | (I) Diarylphthalide class | |
| (1) blue | (2) green | green |
| (4) blue | | |
| | (II) Fluoran class | |
| (5) Yellow | (6) yellow-orange | (7) yellow |
| (8) yellow | (9) yellow | (10) yellow |
| (11) yellow-orange | (12) red | (13) purple-red |
| (14) red-purple | (15) green | (16) blue |
| (17) black | (18) black | (19) black |
| (20) red | (21) red-purple | |
| | (III) Indolylphthalide class | |
| (22) red-purple | (23) purple | (24) blue |
| (25) blue | (26) blue | (27) green-blue |
| (28) green-blue | (29) green-blue | (30) green-blue |
| (31) blue | | |
| | (IV) Acylleucoazine class | |
| (32) blue-green | (33) blue | (34) blue-green |
| (35) red | | |
| | (V) Leucoauramine class | |
| (36) blue | (37) blue | (38) blue |
| (39) blue | | |
| | (VI) Spiropyrane class | |
| (40) dark blue | (41) orange | |
| | (VII) Rhodamine lactam class | |
| (42) red purple | (43) blue | |
| | (VIII) Triarylmethane class | |
| (44) blue | (45) green | (46) blue |
| (47) blue-green | | |
| | (Ix) Chromene class | |
| (48) blue | (49) blue | (50) green |
| | (X) Other classes | |
| (51) yellow | (52) blue-purple | (53) yellow |

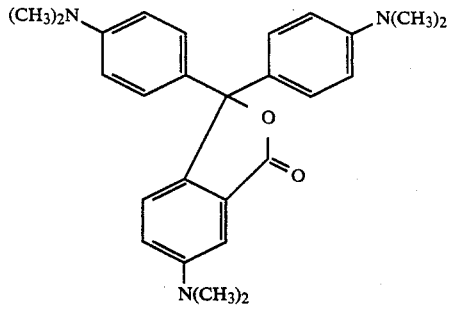

(1)

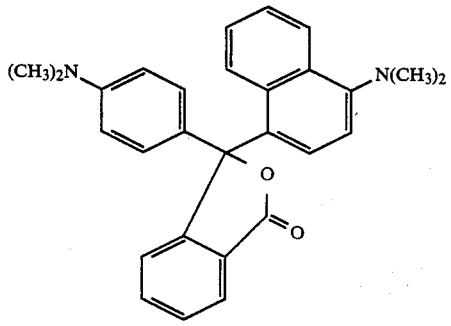

(2)

-continued
(3)
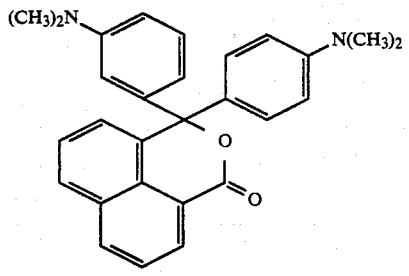
(4)
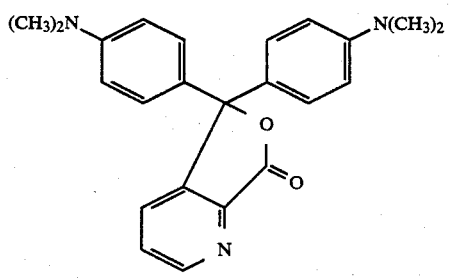
(5)
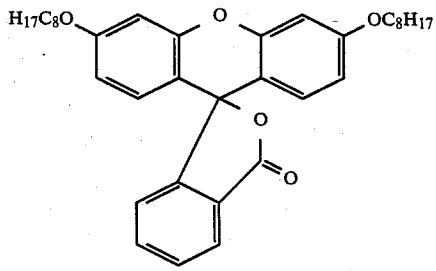
(6)
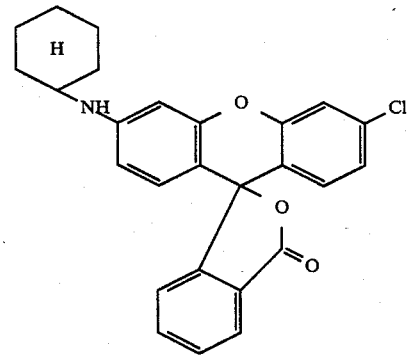
(7)
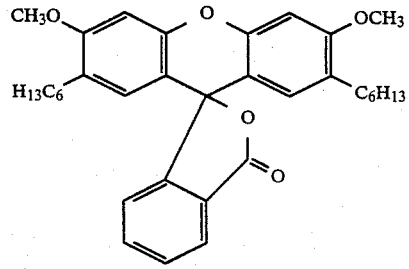

-continued
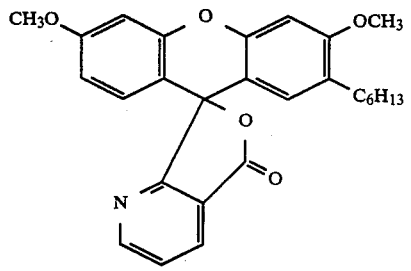
(8)
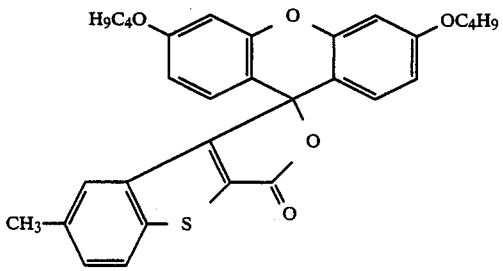
(9)
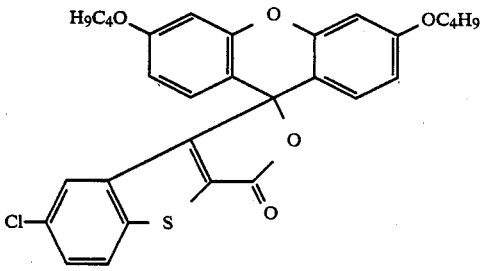
(10)
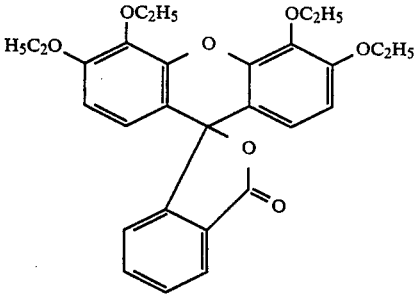
(11)
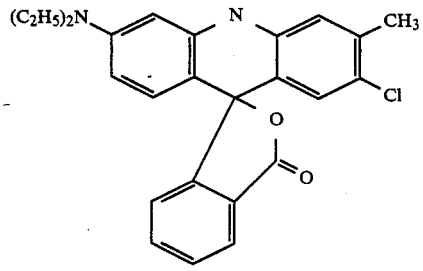
(12)

-continued
(13)
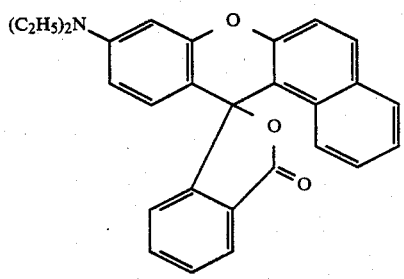
(14)
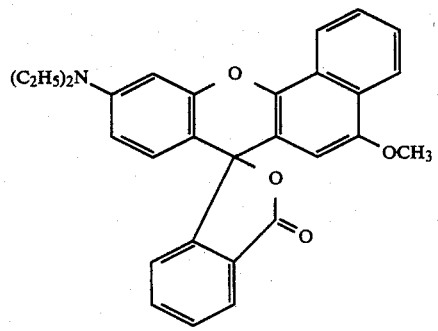
(15)
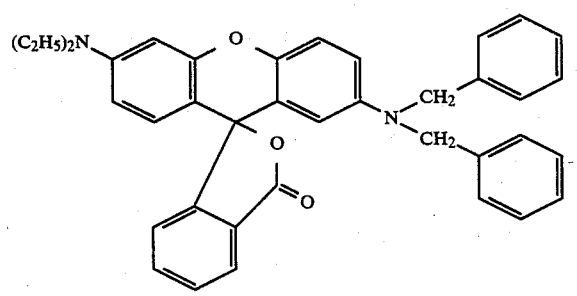
(16)
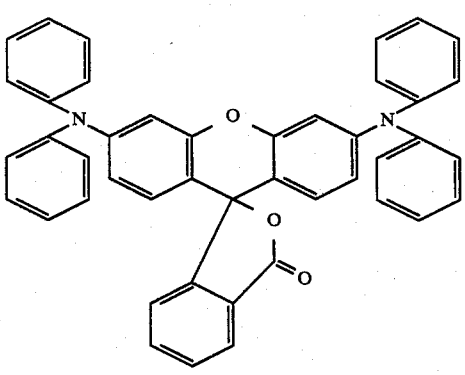
(17)
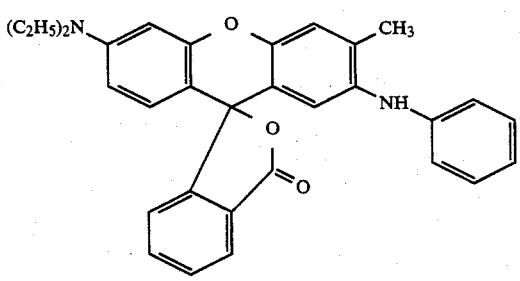

-continued
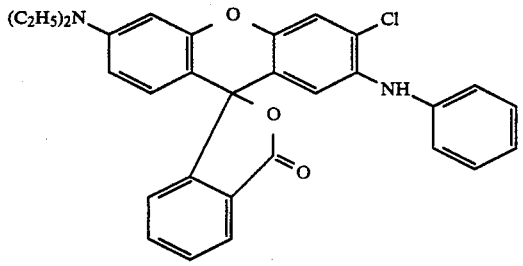
(18)
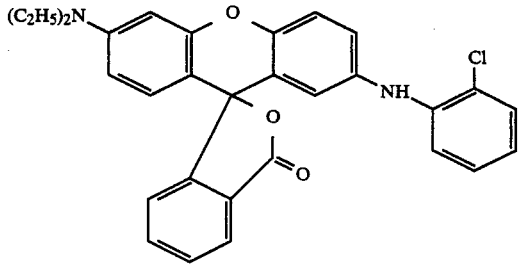
(19)
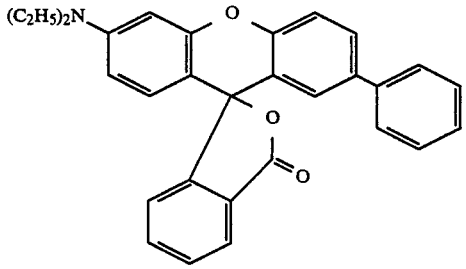
(20)
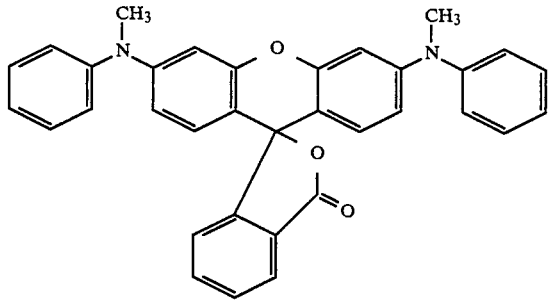
(21)
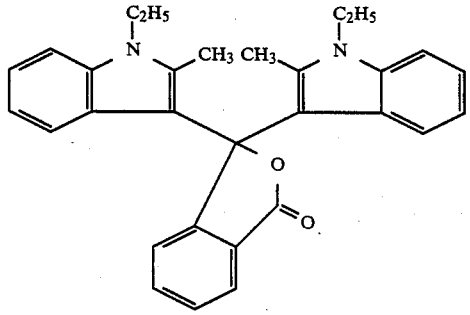
(22)

-continued
(23)
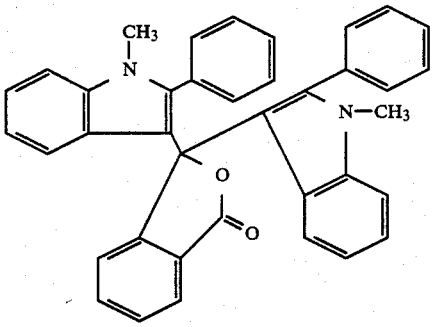
(24)
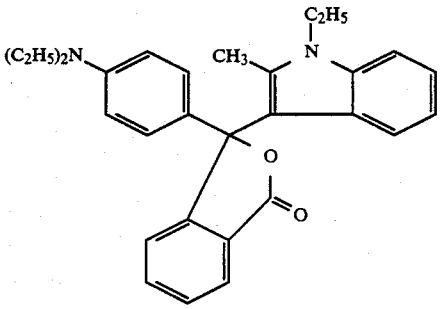
(25)
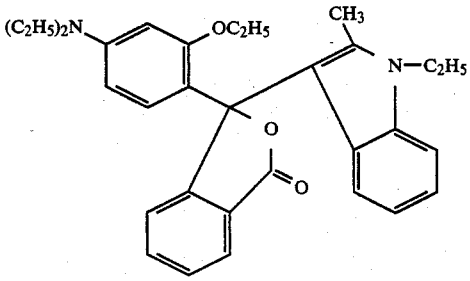
(26)
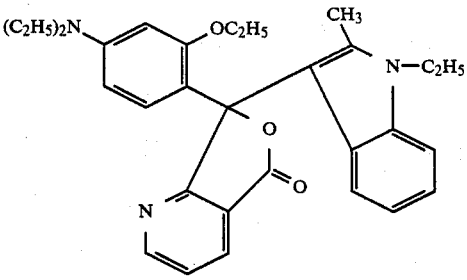
(27)
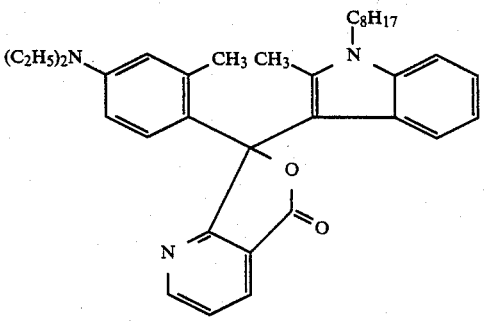

-continued
(28)
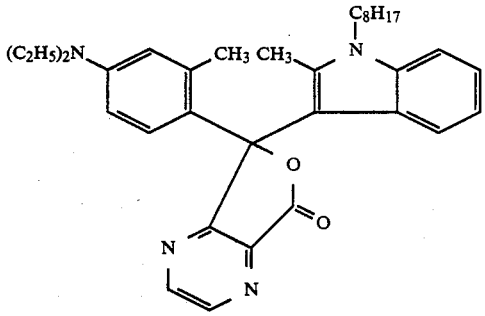
(29)
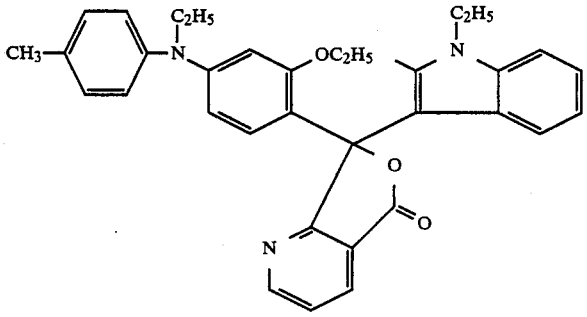
(30)
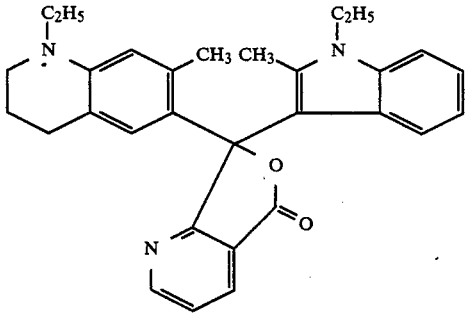
(31)
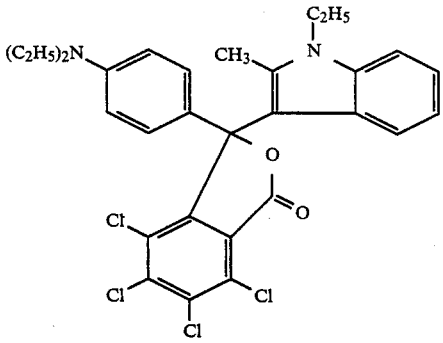
(32)
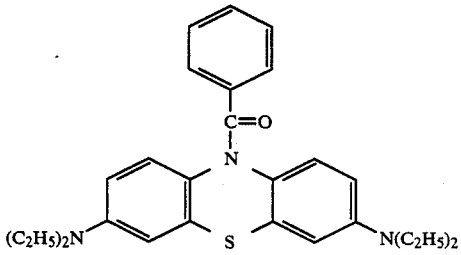
All of the aforesaid leuco-dyestuffs absorb in the visible region when developed, but in addition to these there are other known leuco-dyestuffs which absorb in the near infrared region. The following are examples of lueco-dyestuffs which absorb in the near infrared region.
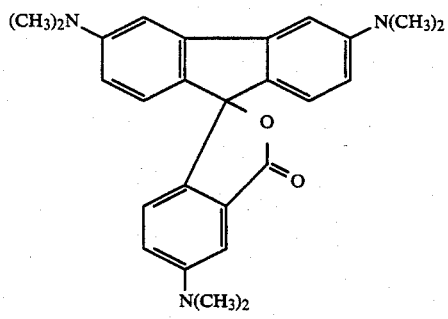
(54)
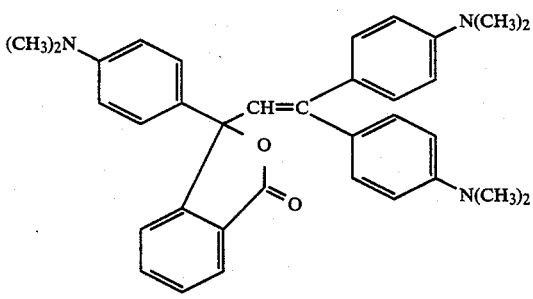
(55)
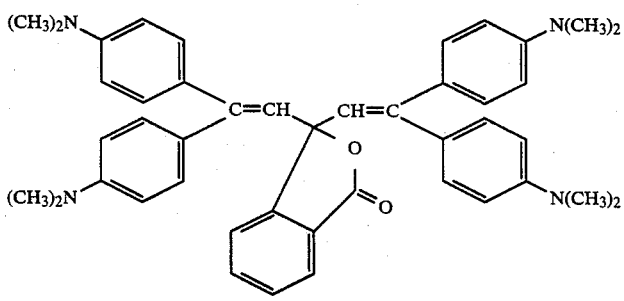
(56)
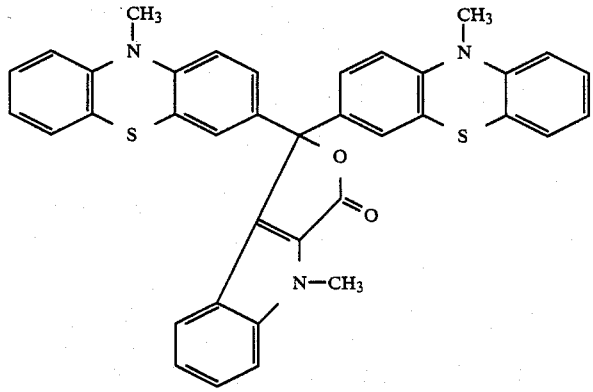
(57)

-continued (58)

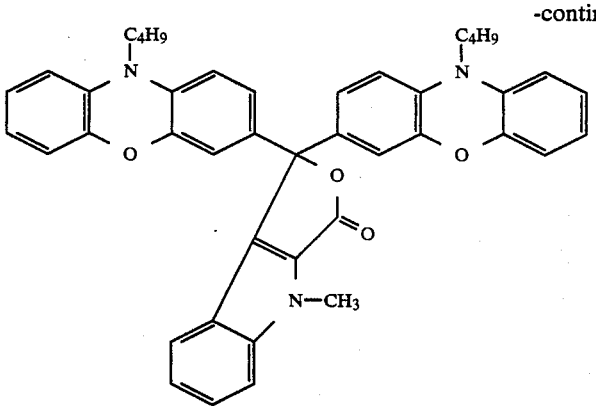

The specific examples given above are just some of the possible leuco-dyestuffs, and the leuco-dyestuffs used in the present invention are not restricted to these. Further, the lueco-dyestuffs can be used alone or two or more may be mixed together.

A metal salt of an organic acid is used as the developer for developing the leuco-dyestuff in the present invention. Examples of these metal salts of organic acids include the metal salts of salicylic acids, the metal salts of resins based on phenols/salicylic acids/formaldehyde, the metal salts of o-sulfonamido benzoic acid, the metal salts of phenol/formaldehyde resins, thiocyanates and the metal salt of xanthogenic acid. Zinc, tin and aluminum are preferred as the metal in the salt, and zinc is more preferred. Among these developers, oil-soluble salicylic acid zinc salts are described in U.S. Pat. Nos. 3,864,146, 4,046,941 and JP-B-52-1327.

Specific examples of preferred metal salts of organic acids for use in the present invention are as follows:

(1)

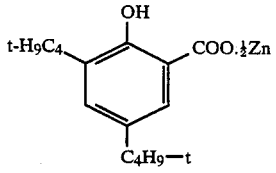

(2)

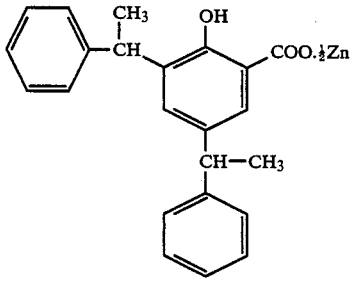

(3)

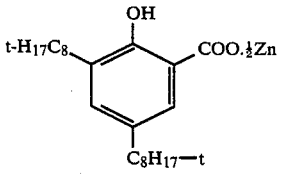

-continued (4)

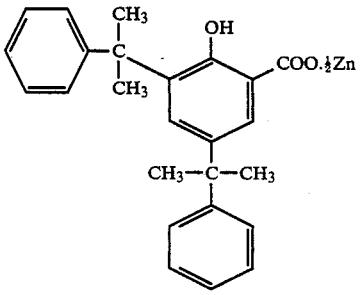

(5)

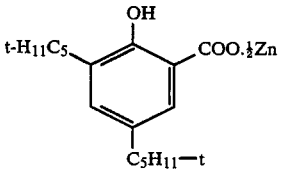

(6)

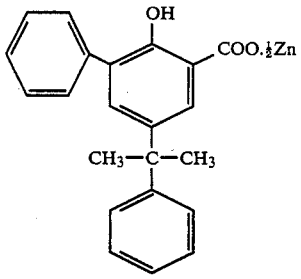

(7)

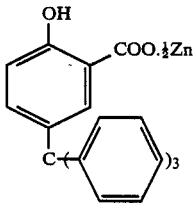

(8)

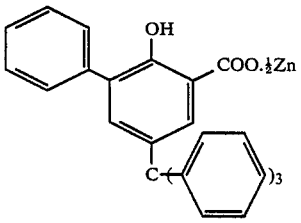

-continued (9)

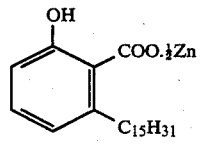

(10)

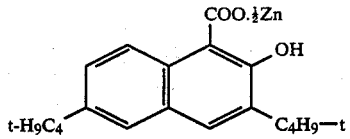

(11)

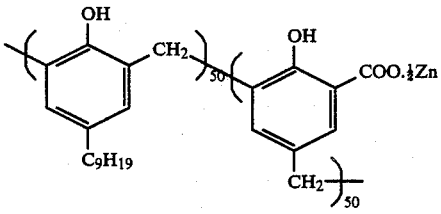

(12)

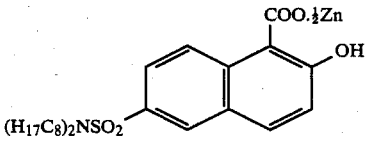

(13)

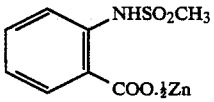

(14)

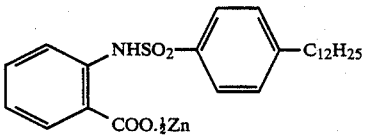

(15)

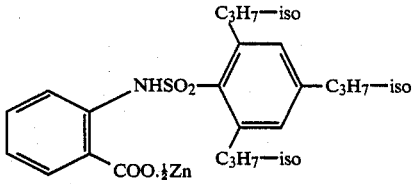

(16)

ZINC SALT OF

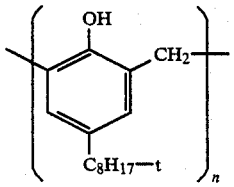

(17)

ZINC SALT OF

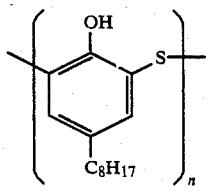

(18)

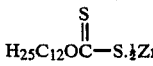

-continued (19)

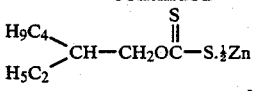

(20)

$Zn(SCN)_2$ (21)

Complex between $Zn(SCN)_2$ and

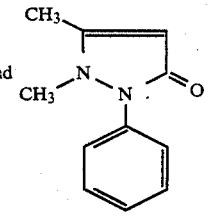

In the present invention, it is necessary to mix together at least one aforesaid leuco-dyestuff and at least one metal salt of an organic acid, to thereby effect color development of the leuco-dyestuff, prior to the exposure of the silver halide light-sensitive material. The obtained developed dyestuff may be added to the coating composition, or alternatively the two components, i.e., the leuco-dyestuff and the metal salt, may be added separately to the coating composition and thus color development is effected within the coating composition.

The method for development of the leuco-dyestaff with the metal salt, i.e., the coloring reaction of the leuco-dyestaff, is basically the same in any cases where the development is effected before adding to the coating composition and effected in the coating composition.

In the case where the development of the dyestaff is effected before adding to the coating composition, the development reaction can be effected by adding the leuco-dyestaff and the metal salt both in the solid state to a suitable organic solvent. The development reaction is completed in 10 minutes while stirring at room temperature.

In the case where the development of the dyestaff is effected in the coating composition, it is preferred that the two components are added to the coating composition before adding a hydrophilic binder such as gelatin. It is more preferred that the two components are added after each is dissolved in a suitable solvent.

As the organic solvents used herein, those used for addition of the compound of the present invention, i.e., the developed dyestaff, described hereinafter can be used.

In the present invention, a single leuco-dyestuff may be used, or two or more leuco-dyestuffs may be employed together. Further, in the case where two or more are used together, they may be a combination of leuco-dyestuffs giving the same color or leuco-dyestuffs giving different colors. Where required, in the case of number of layers, leuco-dyestuffs giving different colors according to the particular layer may be employed.

Furthermore, while one type of organic acid metal salt will normally be appropriate, two or more may also be used together.

The colored composition derived from a leuco-dyestuff and organic acid metal salt in accordance with the present invention may be added to any of the layers of the light-sensitive material. That is to say, any of the layers of a light-sensitive material may constitute the colored layer in the present invention. For example, the colored composition of the present invention may be added to a silver halide emulsion layer (blue-sensitive layer, green-sensitive layer, red-sensitive layer) with the object of preventing irradiation, etc, or it may be added as a filter dye to an intermediate layer (e.g., the intermediate layer interposed between different color-sensitive emulsion layers, or the intermediate layer interposed between substantially identical color-sensitive emulsion layers) or again, to a protective layer. Furthermore, it may be added to a layer below the emulsion layers or on the reverse face of the base to prevent halation.

The following addition amounts and method for addition of the present compounds can be applied to any cases where the dyestaff having been developed by the metal salt is added to the coating composition and the development is effected in the coating composition.

The amount of the leuco-dyestuff added in the present invention is preferably from 1 to $1\times10^3$ mg/m$^2$, and more preferably from 1 to $5\times10^2$ mg/m$^2$. Further, the amount of the organic acid metal salt added in the present invention is preferably from 0.5 to 4 mol equivalents in terms of the added leuco-dyestuff, and more preferably from 0.5 to 1.5 mol equivalents.

The method described in U.S. Pat. No. 3,322,027 incorporated herein by reference may be utilized as the method of adding compounds of the present invention. After dissolving the present compounds in, for example, an alkyl phthalate ester (dibutyl phthalate, dioctyl phthalate), a phosphate ester (diphenyl phosphate, triphenyl phosphate, tricresyl phosphate, dioctyl butyl phosphate), a citrate ester (tributyl acetylcitrate), a benzoate ester (octyl benzoate), an alkyl amide (diethyl laurylamide), a fatty acid ester (dibutoxyethyl succinate, diethyl azelate), a trimesic acid ester (tributyl trimesate), or in an organic solvent with a boiling point of about 30° C. to 150° C., such as ethyl acetate, butyl acetate or other lower alkyl acetate, ethyl propionate, sec-butyl alcohol, methyl isobutyl ketone, β-ethoxyethyl acetate, methylcellosolve acetate. Among these, phthalate esters and benzoate esters are preferred. The resultant mixture is then dispersed in the hydrophilic colloid (coating composition). The aforesaid high-boiling and low-boiling organic solvents may also be mixed together and utilized in combination.

Again, the dispersion methods based on polymers described in JP-B-51-39853 and JP-A-51-59943 (the term "JP-A" as used herein means an "unexamined published Japanese patent application") can also be used.

Introduction into the hydrophilic colloid is also possible in the form of an alkaline aqueous solution, or an alkaline aqueous solution along with a surfactant.

Further, compounds of the present invention can also be added by dispersion in a water-soluble organic solvent such as N,N-dimethylformamide, N,N-dimethylacetamide or methyl cellosolve, or again, after further diluting this with water.

When adding the compounds of the present invention, where necessary, acid may also be added at the same time. The acid may be an organic acid or an inorganic acid. Again, an acidic polymer may also be employed.

In the silver halide emulsion used in the present invention, silver chloride, silver bromide, silver iodide, silver iodobromide, silver iodochlorobromide, silver chlorobromide and silver chloroiodide are preferred.

The silver halide grains used in the invention may have a regular crystal form such as cubic or octahedral, or an irregular crystal form such as a spherical or tabular form, or again, they may have a composite form of such crystal shapes. It is also possible to use grains which comprise a mixture of various crystal forms, but the use of a regular crystal form is preferred.

The silver halide grains employed in the invention may be grains having different phases in the interior and in the surface layer, or they may comprise a uniform phase. Further, they may be grains of the kind such that the latent image is formed chiefly at the surface (e.g., a negative type emulsion), or grains of the type where the image is formed chiefly in the interior of the grain (e.g., an internal latent image type emulsion, or a previously-fogged direct reversal type emulsion). Preferably, the grains will be of the type where the latent image is formed primarily at the surface.

It is preferred that silver halide emulsions used in the present invention are tabular (plate-like) grain emulsions where grains with a mean aspect ratio of 5 or more represent at least 50% of the total projected area, or mono-disperse emulsions with a statistical coefficient of variation (the value $S/\bar{d}$, i.e., the standard deviation S in the case where the projected area is approximated to a circle, divided by the diameter $\bar{d}$) of less than 20%. Again, two or more platelet grain emulsions and mono-disperse emulsions may be mixed.

The photographic emulsions used in the present invention can be prepared by the methods described in "Chemie et Physique Photographique" by P. Grafkides (published by Paul Montel Co., 1967), "Photographic Emulsion Chemistry" by G. F. Duffin (published by the Focal Press, 1966) and "Making and Coating Photographic Emulsion" by V. L. Zelikman (published by the Focal Press, 1964).

Further, the following are examples of solvents suitable for use in the present invention as silver halide solvents for controlling grain growth at the time of the silver halide grain formation, i.e., ammonia, potassium thiocyanate, ammonium thiocyanate, thioester compounds (see, for example, U.S. Pat. Nos. 3,271,157, 3,574,628, 3,704,130, 4,297,439, 4,276,374), thion compounds (see, for example, JP-A-53-144319, JP-A-53-82408, JP-A-55-77737, etc), and amine compounds (see, for example, JP-A-54-100717, etc).

In the silver halide grain formation or physical ripening process, cadmium salts, zinc salts, thallium salts, iridium salts or their complexes, rhodium salts or complexes, or iron salts or iron complexes, may be incorporated.

The silver halide emulsions are normally chemically sensitized and the methods described in, for example, "Die Grundlagen der Photographischen Prozesse mit silberhalogeniden" Ed. by H. Frieser, Akademische Verlags Gesellschaft, 1968, pages 675 to 734 can be used for the chemical sensitization.

For example, the sulfur sensitizing method using a compound containing sulfur which can react with active gelatin or silver (e.g., thiosulfates, thioureas, mercapto compounds, rhodanines); the reduction sensitizing method using a reducing material (e.g., a stannous salt, amines, hydrazine derivatives, formamidine sulfinic acid, silane compounds); and the noble metal sensitizing method using a noble metal compound (e.g., gold complexes, and also complexes of the metals from group VIII of the Periodic Table such as Pt, Ir, Pd), may be employed in the present invention. One such method may be used or they may be used in combination.

It is possible to include various compounds in the silver halide photographic emulsion used in the present invention to prevent fogging of the light-sensitive material in the manufacturing process, during storage or during photographic treatment, or for stabilizing photographic performance. That is to say, it is possible to add numerous compounds known to be antifoggants or stabilizers, such as azoles including benzothiazolium salts, nitroindazoles, triazoles, benzotriazoles, and benzimidazoles (in particular nitro- or halogen-substituted such compounds); heterocyclic mercapto compounds such mercapto thiazoles, mercapto benzothiazoles, mercapto benzimidazoles, mercapto thia diazoles, mercapto tetrazoles (in particular, 1-phenyl-5-mercaptotetrazole), mercapto pyrimidines; the aforesaid heterocyclic mercapto compounds with water soluble groups such as carboxyl or sulfonic groups; thioketo compounds such as oxazoline thione; azaindenes such as tetraazaindenes (in particular 4-hydroxy-substituted (1,3,3a,7)tetraazaindenes); benzene thiosulfonic acids; and benzene sulfinic acid.

The silver halide photographic emulsion of the present invention can contain a cyan coupler, magenta coupler, yellow coupler or other such color coupler, and a compound for dispersing the coupler.

For example, it may contain a compound which, in the color development treatment, can undergo color development by oxidized coupling with an aromatic primary amine developer (e.g., a phenylene diamine derivative, or an aminophenol derivative). For example, as magenta couplers, there are 5-pyrazolone couplers, pyrazolobenzimidazole couplers, cyanoacetylcumarone couplers, pyrazolotriazole couplers, and open-chain acylacetonitrile couplers. As yellow couplers, there are the acylacetamide couplers (e.g., benzoylacetanilides, pivaloylacetanilides), and as the cyan couplers there are the naphthol couplers and phenol couplers. It is preferred that these couplers be non-diffusing, and have a hydrophobic group known as a ballast group in the molecule. The couplers may either be of the 4-equivalent or 2-equivalent type in respect to silver ions. Furthermore, they may also be colored couplers with a color compensating effect, or couplers which release a development restrainer during development (a so-called DIR coupler).

Again, as well as DIR couplers, colorless DIR coupling compounds, the coupling reaction products of which are colorless and which release development restrainers, may also be included.

In the photographic emulsion of the present invention compounds such as the following may be included to raise sensitivity, enhance contrast or accelerate development: polyalkylene oxides or their ethers, esters, amines or other such derivatives; thioether compounds; thiomorpholines; quaternary ammonium salt compounds; urethane derivatives; urea derivatives; imidazole derivatives; and 3-pyrazolidones.

In the silver halide photographic emulsion of the present invention, there may also be used in combination with the dyestuffs of the present invention, known water-soluble dyes other than the dyes disclosed in this invention (e.g., oxonol dyes, hemioxonol dyes or merocyanine dyes) as a filter dye, as an irradiation preventive, or for some other objective. Again, known cyanine dyestuffs, merocyanine dyestuffs and hemicyanine dyestuffs other than the dyes disclosed in this invention may be used jointly as spectral sensitizers.

In the photographic emulsion of the present invention, various types of surfactants may be included for various objectives including as a coating auxiliary, antistatic, improving the sliding properties, or for emulsification dispersion, preventing adhesion and improving the photographic characteristics (e.g., accelerating the developing, adjusting the contrast or sensitizing).

Details relating to the anti-fading agents, hardeners, color antifogging agents, ultraviolet absorbers, gelatin and other protective colloids, and various other additives in the light-sensitive material of the present invention are described in *Research Disclosure*, Vol. 176 (1978, XII) RD-17643.

The finished emulsion is applied onto a suitable base, for example, baryta paper, resin-coated paper, synthetic paper, triacetate film, polyethylene terephthalate film, a plastic base or glass plate.

Examples of the present silver halide photographic light-sensitive material include color positive film, color paper, color negative film, color reversal (a coupler may or may not be included), photographic light-sensitive materials for plate-making (e.g., lith film and lithdupe film), photographic light-sensitive materials for cathode ray tube displays (e.g., light-sensitive material for emulsion X-ray recording, material for direct and indirect photography using a screen), light-sensitive material for the silver salt diffusion transfer process, light-sensitive material for the color diffusion transfer process, light-sensitive material for the inhibition transfer process, light-sensitive material for the silver dye bleaching method, light-sensitive material on which a print-out image is recorded, direct print image light-sensitive material, light-sensitive material for thermal image development, and light-sensitive material for physical image development.

The exposure for obtaining a photographic image can be performed using normal methods. That is to say, it is possible to use any of the many known types of light sources, such as natural light (daylight), a tungsten lamp, fluorescent lamp, mercury lamp, xenon arc lamp, carbon arc lamp, xenon flash lamp, cathode ray tube flying spot, and the like. The exposure time will normally range from 1/1000 to 30 seconds, but it is also possible to employ exposures of less than 1/1000 second, for example, exposures of from $1/10^4$ to $1/60^6$ second using, for example, a xenon flash lamp or cathode ray tube, and again, exposures of longer than 30 seconds may also be used. Where required, it is possible to adjust the spectral composition of the light used by means of a color filter. Again, exposure to laser light can be employed. Moreover, the exposure may be by means of the light emitted from a fluorescent body excited by means of an electron beam, X-rays, $\gamma$-rays or $\alpha$-rays.

The colored composition which comprises a leucodyestuff and an organic acid metal salt is decolored or lightened by eliminating the metal ions at the time of the photographic treatment. The material for effecting elimination of the metal ions from the colored composition is one which can form a complex with the metal ions in the composition (i.e., with the metal ions in the organic acid metal salt), and this role will be fulfilled by the alkanolamines, hydroxylamines, polyalkylenamines, various pH buffers, and various chelating agents, normally included in the silver halide light-sensitive material treatment solution or treatment agent.

Thus, known methods and known treatment solutions such as those described in, for example, *Research Disclosure*, 176, pages 28 to 30 (RD-17643), can be used for the photographic treatment of the light-sensitive material produced using the present invention. This photographic treatment may comprise, according to the particular objectives, either a photographic treatment for forming a silver image (black and white photographic treatment) or a photographic treatment for forming a dyestuff-based image (color photographic treatment). The treatment temperature will normally be selected from the range of about 18° C. to 50° C., but temperatures lower than 18° C. or over 50° C. may also be used.

There are no particular restrictions on the color photographic processing treatment method, and any method can be employed. For example, the following are some typical examples:- following exposure, color development and then a bleach fixing treatment are performed and, where necessary, rinsing and a stabilizing treatment can also be carried out; following exposure, and color development, bleaching and fixing are carried out separately and, where necessary, rinsing and a stabilizing treatment are also performed; following exposure, developing is carried out with a developing solution containing a black and white developer, and then after subjecting the material to uniform exposure color development and a bleach fixing treatment are performed and, where necessary, rinsing and a stabilizing treatment are also carried out; following exposure, developing is carried out with a developing solution containing a black and white developer, after which developing is carried out with a color developing solution containing a fogging agent (e.g., sodium borohydride), and then a bleach fixing treatment is performed and, where necessary, rinsing and a stabilizing treatment are also carried out.

The aromatic primary amine type color developing agents used in the color developing solution in the present invention can include known materials widely used in various color photographic processes. These developing agents include aminophenol type and p-phenylenediamine type derivatives. Preferred examples are the p-phenylenediamine derivatives, and typical examples are given below, although there is no restriction to these.

| | |
|---|---|
| D-1 | N,N—diethyl-p-phenylenediamine |
| D-2 | 2-amino-5-diethylaminotoluene |
| D-3 | 2-amino-5-(n-ethyl-N—laurylamino)toluene |
| D-4 | 4-(N—ethyl-N—(β-hydroxyethyl)amino)aniline |
| D-5 | 2-methyl-4-(N—ethyl-N—(β-hydroxyethyl)amino)-aniline |
| D-6 | N—ethyl-N—(β-methanesulfonamidoethyl)-3-methyl-4-aminoaniline |
| D-7 | N—(2-amino-5-diethylaminophenylethyl)-methanesulfonamide |
| D-8 | N,N—dimethyl-p-phenylenediamine |
| D-9 | 4-amino-3-methyl-N—ethyl-N—methoxyethyl-aniline |
| D-10 | 4-amino-3-methyl-N—ethyl-N—β-ethoxyethyl-aniline |
| D-11 | 4-amino-3-methyl-N—ethyl-N—β-butoxyethyl-aniline |

Further, these p-phenylenediamine derivatives may also be in the form of their salts, such as their sulfates, hydrochlorides, sulfites, or p-toluene sulfonates. The aforesaid compounds are described in U.S. Pat. Nos. 2,193,015, 2,552,241, 2,566,271, 2,592,364, 3,656,950 and 3,698,525. The amount of the said aromatic primary amine color developing agent used will be from about 0.1 g to about 20 g per liter of the developer solution, with a concentration of about 0.5 g to about 10 g per liter further preferred.

Hydroxylamines may optionally be included in the developing solution used in the present invention.

While it is possible to use such hydroxylamines in free amine form in the developing solution, in general they are usually employed in the form of their water-soluble acid salts. Examples of these salts, include the sulfates, oxalates, chlorides, phosphates, carbonates, and acetates. The hydroxylamines may be substituted or unsubstituted, and the nitrogen atom in the hydroxylamine may be alkyl-group substituted.

The amount of hydroxylamine added will preferably be 0 g to 10 g per liter of the developing solution, with 0 g to 5 g being further preferred. To maintain the stability of the developing solution, the amount added should preferably be low.

Further, it is preferred that sodium sulfite, potassium sulfite, sodium bisulfite, potassium bisulfite, sodium metabisulfite, potassium metabisulfite or other such sulfite, or a carbonyl sulfite adduct, be present as a preservative. The amount added is preferably 0 g to 20 g per liter, with 0 g to 5 g per liter still further preferred. To maintain the stability of the developing solution, the amount added should preferably be low.

Furthermore, it is also possible to use as preservatives the aromatic polyhydroxy compounds described in JP-A-52-49828, JP-A-56-47038, JP-A-56-32140, JP-A-59-160142 and U.S. Pat. No. 3,746,544; the hydroxyacetones described in U.S. Pat. No. 3,615,503 and British Pat. No. 1,306,176; the α-aminocarbonyl compounds described in JP-A-52-143020 and JP-A-53-89425; the various metals described in JP-A-57-44148 and JP-A-57-53749, the various saccharides described in JP-A-52-102727; the hydroxamic acids described in JP-A-52-27638; the α'α-dicarbonyl compounds described in JP-A-59-180588; the alkanolamines described in JP-A-54-3532; the polyalkyleneimines described in JP-A-56-94349; and the glycon acid derivatives described in JP-A-56-75647. Two or more of these preservatives may be used together where required. In particular, the addition of 4,5-dihydroxy-m-benzenedisulfonic acid, poly(ethyleneimine) and triethanolamine, is preferred.

The pH of the developing solution used in the present invention is preferably about 9 to 12, with 9 to 11 being further preferred. It is also possible to include other known developing solution components in the developing solution.

In order to maintain the aforesaid pH, it is preferred that some type of buffer be used. Examples of such buffers are carbonates, phosphates, borates, tetraborates, hydroxybenzoates, glycine salts, N,N-dimethylglycine salts, leucine salts, norleucine salts, guanine salts, 3,4-dihydroxyphenylalanine salts, alanine salts, aminobutyric acid salts, 2-amino-2-methyl-1,3-propanediol salts, valine salts, proline salts, trishydroxyaminomethane salts, and lysine salts. In particular, carbonates, phosphates, tetraborates and hydroxybenzoates have a number of advantages in that they exhibit excellent solubility and buffering capability at a pH over 9, they have no adverse effects on photographic performance when added to a color developing solution (i.e., no fogging, etc), and they are cheap. Hence, the use of these buffers is especially preferred.

Specific examples of these buffers include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate, (sodium salicylate), potassium o-hydroxybenzoate, sodium 5-sulfo-2-hydroxybenzoate (sodium 5-sulfosalicylate) and potassium 5-sulfo-2-hydroxybenzoate (potassium 5-sulfo-salicylate). However, the present invention is not to be limited to these compounds.

The amount of buffer added to the developing solution is preferably at least 0.1 mol per liter, and in particular from 0.1 mol per liter to 0.4 mol per liter is especially preferred.

Additionally, various types of chelating agents can be utilized in the developing solution as calcium or magnesium suspending agents or to enhance the stability of the developing solution.

Organic acid compounds are preferred as the chelating agents, for example the aminopolycarboxylic acids described in JP-B-48-030496 and JP-B-44-30232, the organic phosphonic acids described in JP-A-56-97347, JP-B-56-39359 and West German Pat. No. 2,227,639, the phosphonocarboxylic acids described in JP-A-52-102726 JP-A-53-42730, JP-A-54-121127, JP-A-55-126241 and JP-A-55-65956, as well as the compounds described in JP-A-58-195845, JP-A-58-203440 and JP-B-53-40900. Some specific examples are provided below but there is no restriction to them.

| |
|---|
| nitrilotriacetic acid |
| diethyleneaminopentaactic acid |
| ethylenediaminetetraacetic acid |
| triethylenetetraminehexaacetic acid |
| N,N,N—trimethylenephosphonic acid |
| ethylenediamine-N,N,N',N'—tetramethylenephosphonic acid |
| 1,3-diamino-2-propanoltetraacetic acid |
| trans-cyclohexanediaminetetraacetic acid |
| nitrilotripropionic acid |
| 1,2-diaminopropanetetraacetic acid |
| glycoletherdiaminetetraacetic acid |
| hydroxyethylenediaminetriactic acid |
| ethylenediamine-o-hydroxyphenylacetic acid |
| 2-phosphonobutane-1,2,4-tricarboxylic acid |
| 1-hydroxyethane-1,1-diphosphonic acid |
| N,N'—bis(2-hydroxybenzyl)ethylenediamine-N,N'—diacetic acid |

Where required, two or more of these chelating agents may be used together. The amount of chelating agent added should be sufficient to sequester the metal ions in the developing solution, for example, about 0.1 g to 10 g per liter.

Where necessary, a developing accelerator may be added to the developing solution.

It is possible to add, as the developing accelerator, benzyl alcohol, or alternatively the thioether compounds described in JP-B-37-16088, JP-B-37-5987, JP-B-38-7826, JP-B-44-12380, JP-B-45-9019 and U.S. Pat. No. 3,813,247, etc; the p-phenylene diamine compounds described in JP-A-52-49829 and JP-A-50-15554; the quaternary ammonium salts described in JP-A-50-137726, JP-B-44-30074, JP-A-56-156826 and JP-A-52-43429, etc; the p-amonophenols described in U.S. Pat. Nos. 2,610,122 and 4,119,462; the amine compounds described in U.S. Pat. Nos. 2,494,903, 3,128,182, 4,230,796, 3,253,919, JP-B-41-11431, U.S. Pat. Nos. 2,482,546, 2,596,926 and 3,582,346; the polyalkylene oxides described in JP-B-37-16088, JP-B-42-25201, U.S. Pat. No. 3,128,183, JP-B-41-11431, JP-B-42-23883 and U.S. Pat. No. 3,532,501; and also 1-phenyl-3-pyrazolidones, hydrazines, mesoionic type compounds, thione type compounds, and imidazoles, according to the particular requirements. Especially, preferred are the thioether compounds and the 1-phenyl-3-pyrazolidones.

It is possible to add an antifogging agent to the present developing solution, according to the requirements. Alkali metal halides such as potassium bromide, sodium chloride and potassium iodide, and organic antifogging agents can be used for this purpose. Examples of the organic antifogging agents which can be employed are benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole and other nitrogen-containing heterocyclic compounds, 2-mercaptobenzimidazole, 2-mercaptobenzothiazole and other mercapto-substituted heterocyclic compounds, adenine, and also mercapto-substituted aromatic compounds such a thiosalicyclic acid. Such antifogging agents may be built-up in the developing solution by elution from the silver halide light-sensitive material during treatment. However, to reduce the amount discharged, it is preferred that there be only a small amount of such build-up.

A fluorescent whitening agent is preferably included in the developing solution, and a 4,4-diamino-2,2'-disulfostilbene type compound is ideal for this purpose. The amount added may be 0 to 5 g/liter, preferably 0.1 g to 2 g/liter.

Further, where required, various types of surfactants may be added such as alkylphosphonic acids, arylphosphonic acids, aliphatic carboxylic acids, and aromatic carboxylic acids.

The developing solution treatment temperature will preferably be from 30° to 50° C., with 33° to 42° C. being further preferred. The level of replenishment may be 30 to 2,000 ml per square meter of light-sensitive material, and preferably 30 to 1,500 ml. In terms of reducing the quantity of waste liquid, it is preferred that the level of replenishment be kept low.

A ferric ion complex is generally employed as the bleaching agent in the bleaching solution or bleach fixing solution used in the present invention. The ferric ion complex is a complex between ferric ions and a chelating agent such as an aminopolycarboxylic acid, aminopolyphosphonic acid, or their salts. The aminopolycarboxylic acid or aminopolyphosphonic acid salts comprise the alkali metal, ammonium or water-soluble amine salts of the aminopolycarboxylic or aminopolyphosphonic acid. Examples of the alkali metals are sodium, potassium and lithium. Examples of the water-soluble amines are alkylamines such as methylamine, diethylamine, triethylamine, and butylamine, cyclic amines such as cyclohexylamine, arylamines such as aniline and m-toluidine, and heterocyclic amines such as pyridine, morpholine and piperidine.

Typical examples of such chelating agents comprising aminopolycarboxylic acids and aminopolyphosphonic acids, or their salts, include the following:

ethylenediaminetetraacetic acid,
disodium ethylenediaminetetraacetate,
diammonium ethylenediaminetetraacetate,
tetra(trimethylammonium)ethylenediaminetetraacetate,
tetrapotassium ethylenediaminetetraacetate,
tetrasodium ethylenediaminetetraacetate,
trisodium ethylenediaminetetraacetate,
diethylenetriaminepentaacetic acid,
pentasodium diethylenetriaminepentaacetic acid,
ethylenediamine-N-(β-oxyethyl)-N,N',N'-triacetic acid,
trisodium ethylenediamine-N-(β-oxyethyl)-N,N',N'-triacetate,
triammonium ethylenediamine-N-(β-oxyethyl)-N,N',N'-triacetate,
propylenediaminetetraacetic acid, disodium propylenediaminetetraactic acid,
nitrilortiractic acid,
trisodium nitrilotriacetate,
cyclohexanediaminetetraacetic acid,
disodium cyclohexanediaminetetraacetate,
iminodiacetic acid,
dihydroxyethylglycine,
ethyletherdiaminetetraacetic acid,
glycoletherdiaminetetraacetic acid,
ethylenediaminetetrapropionic acid,
phenylenediaminetetraacetic acid,
1,3-diaminopropanol-N,N,N',N'-tetremethylenephosphonic acid,
ethylenedimamine-N,N,N',N'-tetramethylenephosphonic acid,
1,3-propylenediamine-N,N,N',N'tetramethylenephosphonic acid.

The present chelating agents include, but are not to be restricted to these examples.

The ferric ion complex may be used in the form of the complex, or alternatively the said complex may be produced in solution by using a feric salt such as ferric sulfate, ferric chloride, ferric nitrate, ferric ammonium sulfate, or ferric phosphate, and a chelating agent such as an aminopolycarboxylic acid, aminopolyphosphonic acid or phosphonocarboxylic acid. In the case where it is used in the form of a complex, one type of complex, or two or more such complexes, may be used. On the other hand, when the complex is formed in solution using a ferric salt and a chelating agent, one or more than one type of ferric salt may be used. Furthermore, one or more types of chelating agents may also be employed. In either case, the chelating agent may be used in an excess over that required to form the ferric ion complex. Among the iron complexes, aminopolycarboxylic acid iron complexes are preferred, and the amount used may be from 0.01 to 1.0 mol per liter, preferably 0.05 to 0.50 mol per liter.

Again, it is possible to use a bleaching accelerator in the bleaching solution or bleach fixing solution, where required. Specific examples of useful bleaching accelerators include compounds having a mercapto group or disulfide group such as those described in U.S. Pat. No. 3,893,858, West German Pat. Nos. 1,290,812 and 2,059,988, JP-A-53-32736, JP-A-53-57831, JP-A-53-37418, JP-A-53-65732, JP-A-53-72623, JP-A-53-95630, JP-A-53-95631, JP-A-53-104232, JP-A-124424, JP-A-53-141623, JP-A-53-28426, and *Research Disclosure* No. 17129 (July 1978); the thiazolidine derivatives described in JP-A-50-140129; the thiourea derivatives described in JP-B-45-8506, JP-A-52-20832, JP-A-53-32735, and U.S. Pat. No. 3,706,561; the iodides described in West German Pat. No. 1,127,715 and JP-A-58-16235; the polyethylene oxides described in West German Pat. Nos. 966,410, and 2,748,430; the polyamine compounds described in JP-B-45-8836; and also the compounds described in JP-A-49-42434, JP-A-49-59644, JP-A-53-94927, JP-A-54-35727, JP-A-55-26506 and JP-A-58-163940, plus iodine and bromine ions. Among these bleaching accelerators, the compounds with a mercapto group or disulfide group are preferred in that they have a considerable accelerating effect, and particularly preferred are the compounds described in U.S. Pat. No. 3,893,858, West German Pat. No. 1,290,812 and JP-A-53-95630.

Additionally, the bleaching solution or bleach fixing solution may contain bromide (e.g., potassium bromide, sodium bromide, ammonium bromide), chloride (e.g., potassium chloride, sodium chloride, ammonium chloride) or iodide (e.g., ammonium iodide) re-haliding agent. Where required, it is also possible to add one or more inorganic acids, organic acids, or alkali metals or ammonium salts of inorganic acids or organic acids, with a pH buffering capability such as boric acid, borax, sodium metaborate, acetic acid, sodium acetate, potassium carbonate, phosphorous acid, phosphoric acid, sodium phosphate, cirtic acid, sodium citrate, or tartaric acid, as well as ammonium nitrate, guanidine, or other such corrosion inhibitor.

The fixing agent used in the bleach fixing solution or the fixing solution may be a known fixing agent such as sodium thiosufate, ammonium thiosulfate or other such thiosulfate; sodium thiocyanate, ammonium thiocyanate or other such thiocyanate; ethylene-bis-thioglycolic acid, 3,6-dithia-1,8-octandediol or other such thioether compound, and thioureas, or other such water-soluble silver halide dissolving agents, and one of these or a mixture of two or more can be used. Further, it is possible to use a special bleach fixing solution comprising a combination of a large quantity of a halide such as potassium iodide and a fixing agent as described in JP-A-55-155354. In the present invention, the use of a thiosulfate, in particular ammonium thiosulfate is preferred.

The amount of fixing agent per liter is preferably 0.3 to 2 mols, with 0.5 to 1.0 mol being further preferred.

The pH region of the bleach fixing solution or fixing solution is preferably 3 to 10, with 4 to 9 being further preferred. If the pH is lower than this, the desilvering is enhanced but deterioration of the solution and leucoformation of the cyan dyestuff is accelerated. Conversely, if the pH is higher than this, the desilvering is slow and stains readily occur.

Hydrochloric acid, sulfuric acid, bicarbonate, ammonia, potassium hydroxide, sodium hydroxide, sodium carbonate and potassium carbonate, may be added to adjust the pH, as required.

Further, in the bleach fixing solution, it is also possible to include various types of fluorescent whitening agents, antifoaming agents, or surfactants, polyvinylpyrrolidone, or methanol or other organic solvent.

A preservative may be included in the bleach fixing solution or fixing solution. Examples of suitable preservatives include a sulfite (e.g., sodium sulfite, potassium sulfite, ammonium sulfite, a bisulfite (e.g., ammonium bisulfite, sodium bisulfite, potassium bisulfite), a metabisulfite (e.g. potassium metabisulfite, sodium metabisulfite, ammonium metabisulfite), or other such sulfite ion releasing compound. It is preferred that the amount of such a compound included, based on conversion to sulfite ions, be about 0.02 to 0.5 mol per liter, with 0.04 to 0.40 mol per liter being still further preferred.

Ascorbic acid, or a carbonyl bisulfite adduct, or alternatively a carbonyl compound may also be added as a preservative.

Additionally, a buffer, fluorescent whitener, chelating agent, or a fungicide may also be added, as required.

The rinsing process will now be explained. In the present invention, instead of the usual "rinsing treatment", it is also possible to employ a simple treatment method in which only a so-called "stabilizing treatment" is carried out without substantially providing a rinsing process. Thus, "rinsing treatment" in the present invention is used in the aforesaid broad sense.

The amount of rinsing water will vary depending on the number of baths in the multistage countercurrent rinsing, and the amount of prior bath-components carried in by the light-sensitive material, and so it is difficult to be precise, but in the present invention there should be no more than $1\times10^{-4}$ of the bleach fixing solution components in the final rinsing bath. For example, in the case of 3-tank countercurrent rinsing, it is preferred that at least about 1,000 ml is used per 1 $m^2$ of light-sensitive material, with at least 5,000 ml being still further preferred. Again, in the case of a water-saving treatment, 100 to 1,000 ml per 1 $m^2$ of light-sensitive material is preferred.

The rinsing temperature may be 15° to 45° C., and more preferably 20° to 35° C.

In the rinsing treatment process, various types of known compound may be added with to prevent precipitation and to stablize the rinsing water. For example, there may be added as required, inorganic phosphoric acids, aminopolycarboxylic acids, organic phosphonic acids and other chelating agents, various types of bactericides or fungicides for preventing the developments of bacteria, algae or fungi, for example the compounds described in "J. Antibacterial and Antifungal Agents", Vol. 11, No. 5, p. 207 to 223 (1983), and the compounds described in "Bokin Bobai no Kagaku (Antibacterial and Antifungal Chemistry) " by H. Horiguchi, metal salts as typified by magnesium or aluminium salts, alkali metal and ammonium salts, or surfactants for reducing the drying load or preventing unevenness. Alternatively, the compounds described in "Photographic Science and Engineering" Vol. 6, p. 344 to 359 (1965) by West may also be added.

Furthermore, the method of the present invention is particularly effective in the case where there is a considerable reduction in the amount of rinsing water employed using two or more tank multistage counter-current rinsing, with the addition of a chelating agent and germicide or fungicide to the rinsing water. Further, it is also particularly effective in the case where, instead of the normal rinsing process, a multistage countercurrent stabilizing treatment process (a so-called stabilizing treatment) of the kind described in JP-A-57-8543 is carried out. In such circumstances, the bleach fixing solution component in the final bath may be no more than $5\times10^{-2}$ and preferably no more than $1\times10^{-2}$.

Various types of compounds can be added to the stabilizing bath to stabilize the image. For example, typical compounds include aldehydes such as formaline, or various buffers (e.g., combinations of borates, metaborates, borax, phosphates, carbonates, potassium hydroxide, sodium hydroxide, aqueous ammonia, monocarboxylic acids, dicarboxylic acids, and polycarboxylic acids, may be utilized) for adjusting the pH of the film (e.g., to pH 8). Additionally, chelating agents (inorganic phosphoric acids, aminopolycarboxylic acids, organic phosphonic acids, aminopolyphosphonic acids, phosphonocarboxylic acids), bactericides (thiazoles, isothiazoles, halogenated phenols, sulfanilamides, benzotriazoles), surfactants, fluorescent whiteners, hardenres, and other such additives may be used. Two or more compounds may be used together to achieve the same or different objectives.

Further, the addition of an ammonium salt such as ammonium chloride, ammonium nitrate, ammonium sulfate, ammonium phosphate, ammonium sulfite or ammonium thiosulfate as a post-treated film pH regulating agent is preferred for enhancing the image stability.

In the case where the amount of rinsing water is considerably reduced as noted above, introducing a part or all of the overflow rinsing liquid into a previous bath, i.e., the bleach fixing bath or stabilizing bath, is desirable to achieve a lowering of the volume of discharge water.

In a continous treatment process, a constant finish can be obtained by preventing changes in solution composition. Such changes can be prevented by using a replenisher solution for each of the respective treatment liquids. To reduce cost, the standard level of replenishment liquid can be reduced by half or more.

Each treatment bath may optionally include a heater, temperature sensor, liquid level sensor, circulating pump, filter, a floating cover, a squeegee, nitrogen stirrer and/or air stirrer, as required.

The present invention will now be explained by means of examples, but the invention is not to be restricted to these examples. All ratios, percents, etc. are by weight unless otherwise indicated.

EXAMPLE 1

50 g of gelatin was dissolved in 800 g of water, and then a near infrared leuco-dyestuff of the present invention was added in the amount shown in Table 1. Further, organic acid metal salt (2) of the present invention was added in an amount corresponding to 2 equivalents of the dye-stuff, after which the mixture was coated onto cellulose triacetate film.

Further, to 1 kg of a silver chloroiodobromide (bromine content 70 mol %, iodine content 0.2 mol %, average diameter of the silver halide 0.45 microns) emulsion, which had been chemically sensitized by means of gold and a sulfur compound, 60 ml of a 0.05 wt % methanol solution of the sensitizing dyestuff II-1 described in JP-A-59-192242 and shown below, and 40 ml of a 1.0 wt % methanol solution of compound III-1 described in JP-A-59-192242, and shown below was added. Additionally, 30 ml of a 4.0 wt % aqueous solution of sodium dodecylbenzenesulfonate and 35 ml of a 1.0 wt % aqueous solution of the sodium salt of 1-hydroxy-3,5-dichlorotriazine were added, and the resultant mixture was stirred. After stirring, the mixture was applied onto the aforesaid film.

disodium 4,4-bis(4,6-di(benzothiazolyl-2-thio)pyrimidin-2-ylamino)stilbene-2,2'-disulfonate (II-1)

(III-1)

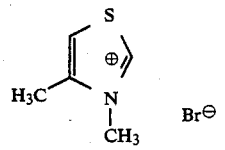

As a protective layer, an aqueous solution containing gelatin and sodium dodecylbenzenesulfonate was applied on top of the aforesaid layer.

The above resultant test samples were subjected to optical wedge exposure through a dark red filter (SC-72, manufactured by the Fuji Photo Film Co.) and then developed for 4 minutes at 20° C. with the developing solution shown below. After stopping/fixing, rinsing was carried out. Density measurements were then performed using a Fuji Photo Film Co., Ltd., P-type densitometer, and sensitivity and fogging values were obtained (sensitivity is represented by the reciprocal of the exposure giving an optical density of fogging +0.3).

The evaluation of the image quality was based on five grades, ranging from 1 (many fringes, and very poor image quality) to 5 (no fringes, and sharp image). The evaluation of residual color was based on five grades, ranging from 1 (considerable residual color) to 5 (absolutely no residual color).

The results are shown in Table 1A. The below illustrated dye, as described in U.S. Pat. No. 2,895,955 was used as a comparative dye.

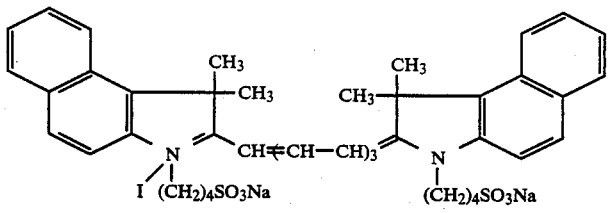

TABLE 1A

| No. | Near IR Leuco Dyestuff | Amount Added (g/m²) | Relative Sensitivity | Image Fogging | Quality |
|---|---|---|---|---|---|
| 101 | — | — | 100 | 0.04 | 1 |
| 102 | 54 | 0.01 | 78 | 0.04 | 3 |
| 103 | 54 | 0.02 | 66 | 0.04 | 4 |
| 104 | 55 | 0.01 | 87 | 0.04 | 3 |
| 105 | 55 | 0.02 | 75 | 0.04 | 4 |
| 106 | 56 | 0.01 | 91 | 0.04 | 3 |
| 107 | 56 | 0.02 | 85 | 0.04 | 4 |
| 108 | 57 | 0.01 | 94 | 0.04 | 3 |
| 109 | 57 | 0.02 | 85 | 0.04 | 4 |
| 110 | comparative dye | 0.02 | 42 | 0.09 | 2 |

| Developing solution formulation: | |
|---|---|
| Metol | 0.31 g |
| Anhydrous sodium sulfite | 39.6 g |
| Hydroquinone | 6.0 g |
| Anhydrous sodium carbonate | 18.7 g |
| Potassium bromide | 0.86 g |
| Citric acid | 0.68 g |
| Potassium metabisulfite | 1.5 g |
| Water to make | 1 liter |

It is clear from Table 1A that while the use of the leuco-dyestuff of the present invention causes a slight reduction in sensitivity, this is far less than in the case of the comparative dye. Further, there is no increase in fogging and the image quality is excellent. (Sample Nos. 102 to 109).

Another set of test samples 101 to 110 were exposed using a 783 nm semi-conductor laser, and a development treatment was carried out utilizing a treatment solution used for printing (treatment solution GS-1, manufactured by Fuji Photo Film Co.). The development treatment was carried out at a temperature of 38° C. for 30 seconds.

The image quality obtained in each case was evaluated in the manner described above and the results are shown in Table 1B.

TABLE 1B

| No. | Fogging | Image Quality |
|---|---|---|
| 101 | 0.04 | 1 |
| 102 | 0.04 | 4 |
| 103 | 0.04 | 5 |
| 104 | 0.04 | 4 |
| 105 | 0.04 | 5 |
| 106 | 0.04 | 4 |
| 107 | 0.04 | 5 |
| 108 | 0.04 | 4 |
| 109 | 0.04 | 5 |
| 110 (for comparison) | 0.10 | 1 |

TABLE 1B-continued

It will be clear from Table 1B that, by means of the system of the present invention, light-sensitive materials are obtained with excellent image quality and low fogging (Sample Nos. 102 to 109).

EXAMPLE 2

A multilayer silver halide light-sensitive material (Sample 201) was produced with a layer structure as detailed below, on a paper base laminated on both faces with polyethylene. The coating solutions were prepared as follows. Preparation of the first layer coating solution:

27.2 cc of ethyl acetate and 7.7 cc (8.0 g) of high boiling solvent (Solv-1) were added to 19.1 g of yellow coupler (ExY-1) and 4.4 g of color image stabilizer (Cpd-1), forming a solution. An emulsion dispersion of this solution was then produced in 185 cc of a 10% aqueous gelatin solution containing 8 cc of 10% sodium dodecylbenzenesulfonate. Emulsions EM7 and EM8 (defined below) were mixed and dissolved in this emulsion dispersion. The gelatin concentration of the composition was then adjusted as shown below to produce the first layer coating solution. Coating solutions for the second to the seventh layers were also prepared by an identical method. The gelatin hardener used in each layer was the sodium salt of 1-oxy-3,5-dichloro-s-triazine.

Further, (Cpd-2) was used as the thickner. Layer structure:

The compositions of the respective layers are given below. The figures represent coverage in g/m². In regard to silver halide emulsions, the figure represents coverage based on conversion to silver.

| | |
|---|---|
| Base | |
| Polyethylene-laminated paper (The polyethylene on the first layer side contained white pigment ($TiO_2$) and blue dye) | |
| First Layer (Blue-sensitive Layer) | |
| Monodisperse silver chlorobromide emulsion (EM7) spectrally sensitized with sensitizing dye (ExS-1) | 0.15 |
| Monodisperse silver chlorobromide emulsion (EM8) spectrally sensitized with sensitizing dye (ExS-1) | 0.15 |
| Gelatin | 1.86 |
| Yellow coupler (ExY-1) | 0.82 |
| Color image stabilizer (Cpd-1) | 0.19 |
| Solvent (Solv-1) | 0.35 |
| Second Layer (Mixing Preventive Layer) | |
| Gelatin | 0.99 |
| Color mixing preventive (Cpd-3) | 0.05 |
| Third Layer (Green-sensitive Layer) | |
| Monodisperse silver chlorobromide | 0.12 |

-continued

| | |
|---|---|
| emulsion (EM9) spectrally sensitized with sensitizing dyes (ExS-2, 3) | |
| Monodisperse silver chlorobromide emulsion (EM10) spectrally sensitized with sensitizing dyes (ExS-2, 3) | 0.24 |
| Gelatin | 1.24 |
| Magenta coupler (ExM-1) | 0.39 |
| Color iamge stabilizer (Cpd-4) | 0.25 |
| Color iamge stabilizer (Cpd-5) | 0.12 |
| Solvent (Solv-2) | 0.25 |
| Fourth Layer (Ultraviolet Absorbing Layer) | |
| Gelatin | 1.60 |
| Ultraviolet absorber (Cpd-6/Cpd-7/Cpd-8 = 3/2/6: weight ratio) | 0.70 |
| Color mixing preventive (Cpd-9) | 0.05 |
| Solvent (Solv-3) | 0.42 |
| Fifth Layer (Red-sensitive Layer) | |
| Monodisperse silver chlorobromide emulsion (EM11) spectrally sensitized with sensitizing dyes (ExS-4, 5) | 0.07 |
| Monodisperse silver chlorobromide emulsion (EM12) spectrally sensitized with sensitizing dyes (ExS-4, 5) | 0.16 |
| Gelatin | 0.92 |
| Cyan coupler (ExC-1) | 1.46 |
| Cyan coupler (ExC-2) | 1.84 |
| Color image stabilzer (Cpd-7/Cpd-8/Cpd-10 = 3/4/2: weight ratio) | 0.17 |
| Irradiation preventing dye | 0.015 |
| Polymer for dispersion (Cpd-11) | 0.14 |
| Solvent (Solv-1) | 0.20 |
| Sixth Layer (Ultraviolet Absorbing Layer) | |

-continued

| | |
|---|---|
| Gelatin | 0.54 |
| Ultraviolet absorbing agent (Cpd-6/Cpd-8/Cpd-10 = 1/5/3: weight ratio) | 0.21 |
| Solvent (Solv-4) | 0.08 |
| Seventh Layer (Protective Layer) | |
| Gelatin | 1.33 |
| Polyvinyl alcohol acrylic modified copolymer (degree of modification 17%) | 0.17 |
| Liquid paraffin | 0.03 |

In the various layers, Alkanol XC (DuPont), sodium alkylbenzene sulfonate, succinate ester and Magefacx F-120 (manufactured by Dainippon Ink) were used as emulsion dispersion agent coating auxiliaries. Cpd-14 and Cpd-15 were used as silver halide stabilizers.

Details of the emulsions used were as follows:

| Emulsion | Form | Grain Diameter | Br Content (mol %) | Coef. of Variation |
|---|---|---|---|---|
| EM7 | Cubic | 1.1 | 1.0 | 0.10 |
| EM8 | " | 0.8 | 1.0 | 0.10 |
| EM9 | " | 0.45 | 1.5 | 0.09 |
| EM10 | " | 0.34 | 1.5 | 0.09 |
| EM11 | " | 0.45 | 1.5 | 0.09 |
| EM12 | " | 0.34 | 1.6 | 0.10 |

$$\text{Coefficient of variation} = \frac{\text{standard deviation}}{\text{average size}}$$

ExY-1

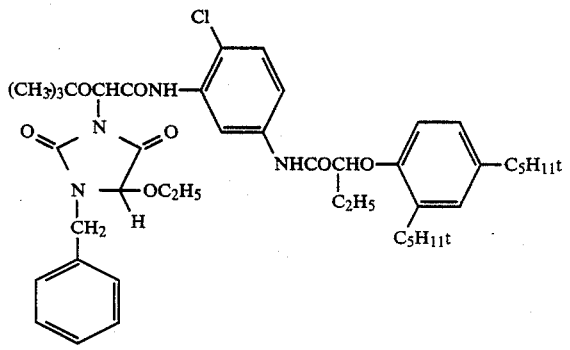

ExM-1

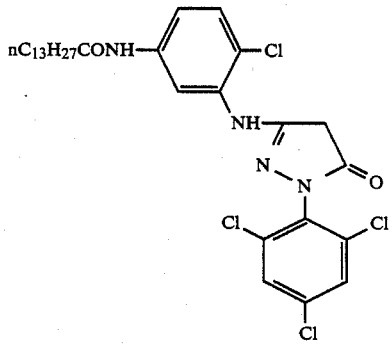

ExC-1

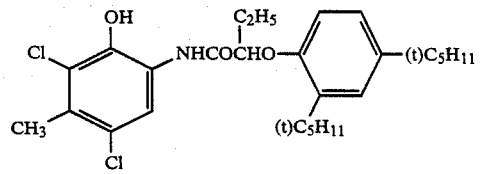

-continued
ExC-2
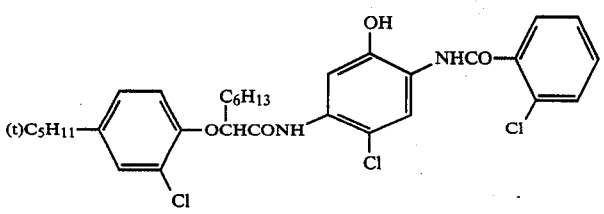
Cpd-1
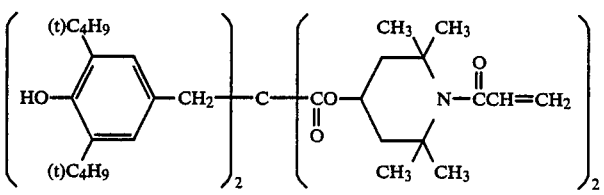
Cpd-2
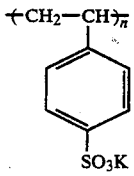
Cpd-3
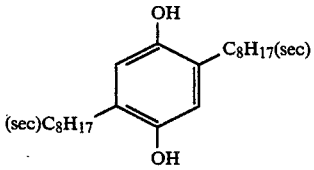
Cpd-4
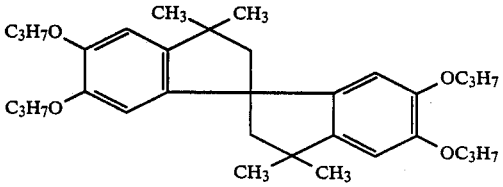
Cpd-5
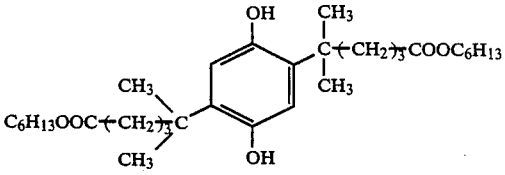
ExS-1
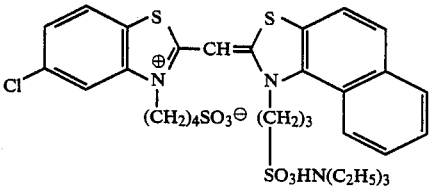
ExS-2
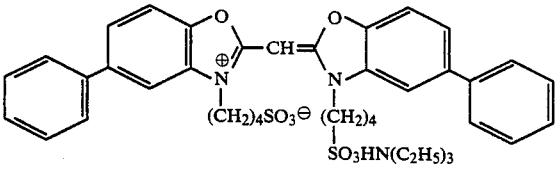

-continued
ExS-3
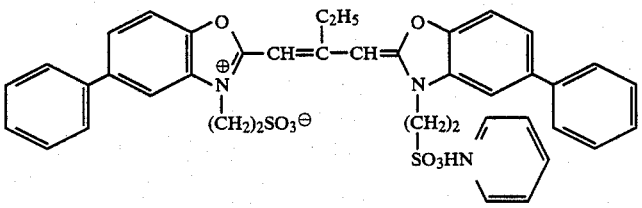
ExS-4
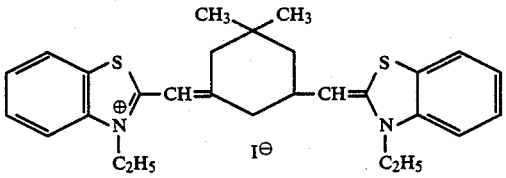
ExS-5
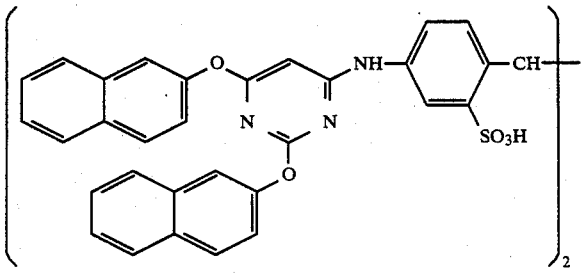
Cpd-6
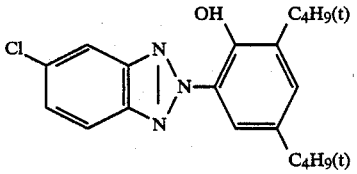
Cpd-7
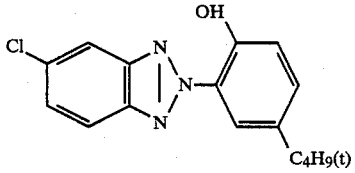
Cpd-8
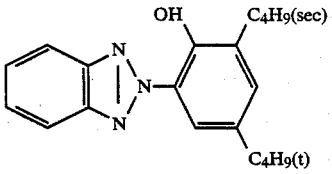
Cpd-9
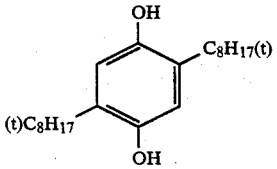
Cpd-10
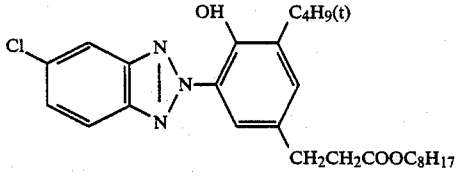

-continued

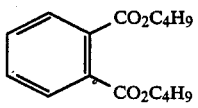

Solv-1

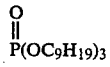

Solv-2

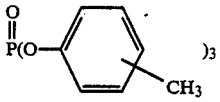

Solv-3

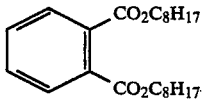

Solv-4

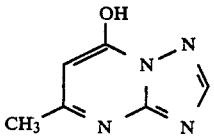

Cpd-14

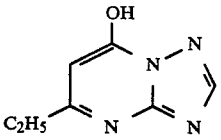

Cpd-15

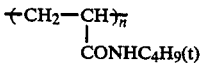

(n = 100–1000) molecular weight 100,000

Cpd-11

Manufacture of Samples 202 to 205

With the exception of the fact that compounds of the present invention were added to the 5th layer of Sample 201, Samples 202 to 205 were produced in the same way as Sample 201. (Details of the compounds are shown in Table 2 below).

The above-described samples were left for 10 days at 35° C. and 80% RH, and then the percentage residual dye determined. Further, the samples were given an imaging exposure at 25° C. and 55% RH, then the following developing treatment was carried out and the relative sensitivity at an optical density of 1.0 was evaluated. The results are shown in Table 2.

| Treatment Process | Temperature (°C.) | Time |
|---|---|---|
| Color development | 35 | 45 sec. |
| Bleach-fixing | 30 to 35 | 45 sec. |
| Rinse-1 | 30 to 35 | 20 sec. |
| Rinse-2 | 30 to 35 | 20 sec. |
| Rinse-3 | 30 to 35 | 20 sec. |
| Rinse-4 | 30 to 35 | 30 sec. |
| Drying | 70 to 80 | 60 sec. |

(A three-tank countercurrent system was employed for Rinses 4 to 1)

The composition of each of the treatment solutions was as follows:

| Color Developing Solution | |
|---|---|
| Water | 800 ml |
| Ethylenediamine-N,N,N,N—tetramethylenephosphonic acid | 1.5 g |
| Triethylenediamine(1,4-diazabicyclo(2,2,2)octane) | 5.0 g |
| Sodium chloride | 1.4 g |
| Potassium carbonate | 25.0 g |
| N—Ethyl-N—(2-methanesulfonamidoethyl)-3-methyl-4-aminoaniline sulfate | 5.0 g |
| N,N—Diethylhydroxylamine | 4.2 g |
| Fluorescent whitening agent (UVITEX CR, Ciba Geigy) | 2.0 g |
| Water to make | 1,000 ml |
| pH (25° C.) | 10.10 |
| **Bleach-fixing Solution** | |
| Water | 400 ml |
| Ammonium thiosulfate (70%) | 100 ml |
| Sodium sulfate | 18 g |
| Fe(II) ammonium ethylenediamine-tetraacetate | 55 g |
| Disodium ethylenediamine-tetraacetate | 3 g |
| Ammonium bromide | 40 g |
| Glacial acetic acid | 8 g |
| Water to make | 1,000 ml |
| pH (25° C.) | 5.5 |
| **Rinse Liquid** | |
| Ion-exchange water (calcium and magnesium both below 3 ppm) | |

TABLE 2

| Sample | Dye/Leuco Dyestuff | Organic Acid Metal Salt | Residue (%) | Relative Sensitivity* |
|---|---|---|---|---|
| 201 | Cpd-12 | — | 64 | 100 |
| 202 | Leuco-dye (27) | (3) | 97 | 109 |
| 203 | Leuco-dye (28) | (4) | 98 | 110 |
| 204 | Leuco-dye (29) | (8) | 97 | 115 |

TABLE 2-continued

| Sample | Dye/Leuco Dyestuff | Organic Acid Metal Salt | Residue (%) | Relative Sensitivity* |
|---|---|---|---|---|
| 205 | Leuco-dye (30) | (5) | 99 | 112 |

*Relative value, taking the sensitivity of Sample 201 as 100.
Sample 201 is a comparative example.
Samples 202 to 205 are in accordance with this invention.

As is clear from Table 2, in the case of Samples 202 to 205 which employ a leuco-dyestuff of the present invention, Stability in the film is excellent. Furthermore, the relative sensitivity is high and there is little reduction in sensitivity at high humidity.

EXAMPLE 3

Layers of the compositions described below were separately applied onto a cellulose triacetate film base which had been undercoated, to produce a multilayer color light-sensitive material, Sample 301. Composition of the light-sensitive layers:

The numbers corresponding to the respective components represent coverage expressed in units of g/m$^2$. In the case of the silver halide, coverage is shown based on conversion to silver. Further, in the case of the sensitizing dyestuffs, the coverage in terms of 1 mol of silver halide in the same layer is expressed in molar units.

Sample 301

| | |
|---|---|
| First Layer (Antihalaion Layer) | |
| Black colloidal silver | Ag 0.18 |
| Gelatin | 0.40 |
| Second Layer (Intermediate Layer) | |
| 2,5-Di-t-pentadecylhydroquinone | 0.18 |
| EX-1 | 0.07 |
| EX-3 | 0.02 |
| EX-12 | 0.002 |
| U-1 | 0.06 |
| U-2 | 0.08 |
| U-3 | 0.10 |
| HBS-1 | 0.10 |
| HBS-2 | 0.02 |
| Gelatin | 1.04 |
| Third Layer | |
| (First Red-sensitive Emulsion Layer) | |
| Monodisperse silver iodobromide emulsion (silver iodide 6 mol %, average grain diameter 0.6 μm, coefficient of variation in terms of grain diameter 0.15) | Ag 0.55 |
| Sensitizing dye I | $6.9 \times 10^{-5}$ |
| Sensitizing dye II | $1.8 \times 10^{-5}$ |
| Sensitizing dye III | $3.1 \times 10^{-4}$ |
| Sensitizing dye IV | $4.0 \times 10^{-5}$ |
| EX-2 | 0.350 |
| HBS-1 | 0.005 |
| EX-10 | 0.020 |
| Gelatin | 1.20 |
| Fourth Layer | |
| (Second Red-sensitive Emulsion Layer) | |
| Platelet silver iodobromide emulsion (silver iodide 10 mol %, average grain diameter 0.7 μm, average aspect ratio 5.5, average thickness 0.2 μm) | Ag 1.0 |
| Sensitizing dye I | $5.1 \times 10^{-5}$ |
| Sensitizing dye II | $1.4 \times 10^{-5}$ |
| Sensitizing dye III | $2.3 \times 10^{-4}$ |
| Sensitizing dye IV | $3.0 \times 10^{-5}$ |
| EX-2 | 0.400 |
| EX-3 | 0.050 |
| EX-10 | 0.015 |
| Gelatin | 1.30 |
| Fifth Layer | |
| (Third Red-sensitive Emulsion Layer) | |
| Silver iodobromide emulsion (silver iodide 16 mol %, average grain diameter 1.1 μm) | Ag 1.60 |
| Sensitizing dye IX | $5.4 \times 10^{-5}$ |
| Sensitizing dye II | $1.4 \times 10^{-5}$ |
| Sensitizing dye III | $2.4 \times 10^{-4}$ |
| Sensitizing dye IV | $3.1 \times 10^{-5}$ |
| EX-3 | 0.240 |
| EX-4 | 0.120 |
| HBS-1 | 0.22 |
| HBS-2 | 0.10 |
| Gelatin | 1.63 |
| Six Layer (Intermediate Layer) | |
| EX-5 | 0.040 |
| HBS-1 | 0.020 |
| Gelatin | 0.80 |
| Seventh Layer | |
| (First Green-sensitive Emulsion Layer) | |
| Platelet silver iodobromide emulsion (silver iodide 6 mol %, average grain diameter 0.6 μm, average aspect ratio 6.0, average thickness 0.15 μm) | Ag 0.40 |
| Sensitizing dye V | $3.0 \times 10^{-5}$ |
| Sensitizing dye VI | $1.0 \times 10^{-4}$ |
| Sensitizing dye VII | $3.8 \times 10^{-4}$ |
| EX-6 | 0.260 |
| EX-1 | 0.021 |
| EX-7 | 0.030 |
| EX-8 | 0.025 |
| HBS-1 | 0.100 |
| HBS-4 | 0.010 |
| Gelatin | 0.75 |
| Eighth Layer | |
| (Second Green-sensitive Emulsion Layer) | |
| Monodisperse silver iodobromide emulsion (silver iodide 9 mol %, average grain diameter 0.7 μm, coefficient of variation in terms of the grain diameter 0.18) | Ag 0.80 |
| Sensitizing dye V | $2.1 \times 10^{-5}$ |
| Sensitizing dye VI | $7.0 \times 10^{-5}$ |
| Sensitizing dye VII | $2.6 \times 10^{-4}$ |
| EX-6 | 0.180 |
| EX-8 | 0.010 |
| EX-1 | 0.008 |
| EX-7 | 0.012 |
| HBS-1 | 0.160 |
| HBS-4 | 0.008 |
| Gelatin | 1.10 |
| Ninth Layer | |
| (Third Green-sensitive Emulsion Layer) | |
| Silver iodobromide emulsion (silver iodide 12 mol %, average grain diameter 1.0 μm) | Ag 1.2 |
| Sensitizing dye V | $3.5 \times 10^{-5}$ |
| Sensitizing dye VI | $8.0 \times 10^{-5}$ |
| Sensitizing dye VII | $3.0 \times 10^{-4}$ |
| EX-6 | 0.065 |
| EX-11 | 0.030 |
| EX-1 | 0.025 |
| HBS-1 | 0.25 |
| HBS-2 | 0.10 |
| Gelatin | 1.74 |
| Tenth Layer (Yellow Filter Layer) | |
| Yellow colloidal silver | Ag 0.05 |
| EX-5 | 0.08 |
| HBS-3 | 0.03 |
| Gelatin | 0.95 |
| Eleventh Layer | |
| (First Blue-sensitive Emulsion Layer) | |
| Platelet silver iodobromide emulsion (silver iodide 6 mol %, average grain diameter 0.6 μm, average aspect ratio 5.7, average thickness 0.15) | Ag 0.24 |
| Sensitizing dye VIII | $3.5 \times 10^{-4}$ |
| EX-9 | 0.85 |
| EX-8 | 0.12 |
| HBS-1 | 0.28 |
| Gelatin | 1.28 |

-continued

| | |
|---|---|
| Twelfth Layer | |
| (Second Blue-sensitive Emulsion Layer) | |
| Monodisperse silver iodobromide emulsion (silver iodide 10 mol %, average grain diameter 0.8 μm, coefficient of variation in relation to grain diameter 0.16 μm) | Ag 0.45 |
| Sensitizing dye VIII | $2.1 \times 10^{-4}$ |
| EX-9 | 0.20 |
| EX-10 | 0.015 |
| HBS-1 | 0.03 |
| Gelatin | 0.46 |
| Thirteenth Layer | |
| (Third Blue-sensitive Emulsion Layer) | |
| Silver iodobromide emulsion (silver iodide 14 mol %, average grain diameter 1.3 μm) | Ag 0.77 |
| Sensitizing dye VIII | $2.2 \times 10^{-4}$ |
| EX-9 | 0.20 |
| HBS-1 | 0.07 |

-continued

| | |
|---|---|
| Gelatin | 0.69 |
| Fourteenth Layer (First Protective Layer) | |
| Silver iodobromide emulsion (silver iodide 1 mol %, average grain diameter 0.07 μm) | Ag 0.5 |
| U-4 | 0.11 |
| U-5 | 0.17 |
| HBS-1 | 0.90 |
| Gelatin | 1.00 |
| Fifteenth Layer (Second Protective Layer) | |
| Polymethylacrylate particles (diameter about 1.5 μm) | 0.54 |
| S-1 | 0.15 |
| S-2 | 0.05 |
| Gelatin | 0.72 |

In addition to the components specified above, gelatin haedener H-1 and surfactant were added to each layer.

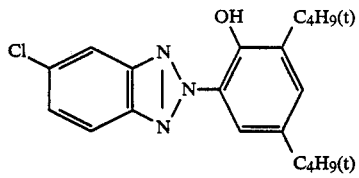

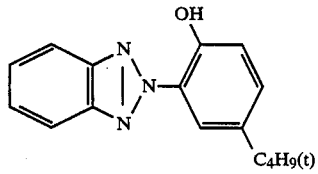

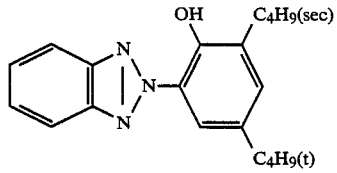

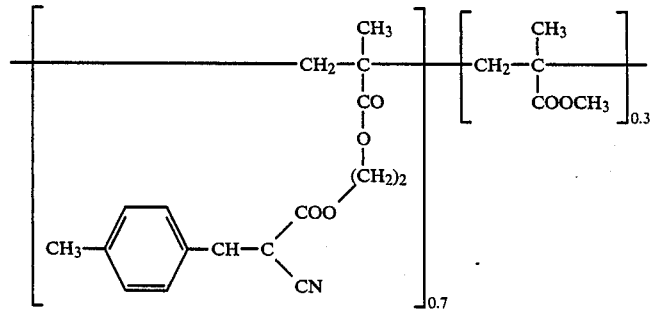

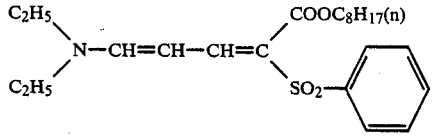

-continued
EX-1
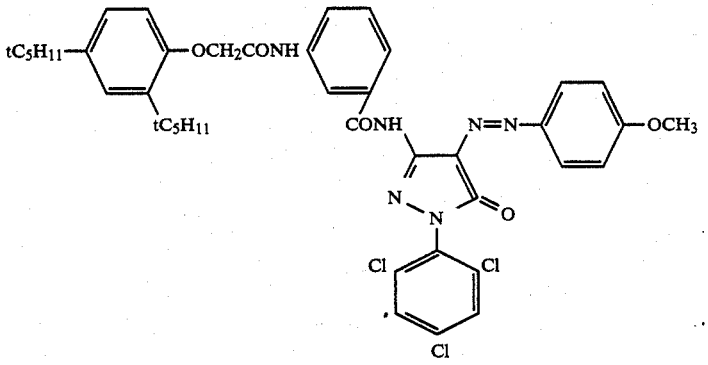
EX-2
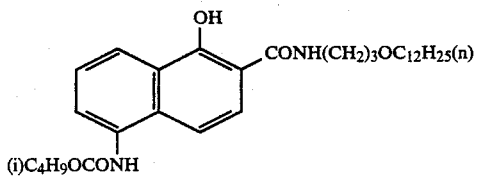
EX-3
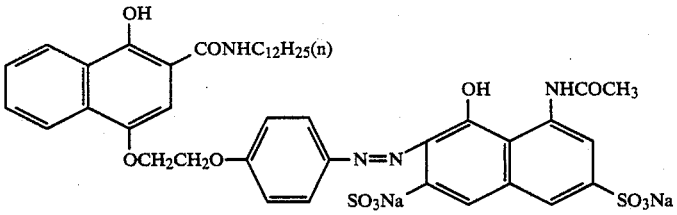
EX-4
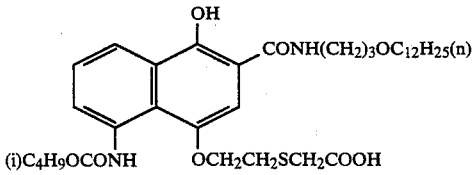
EX-5
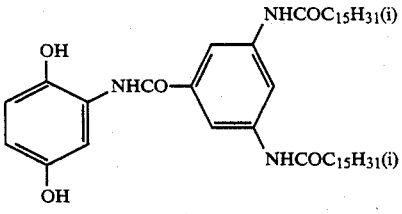
EX-6
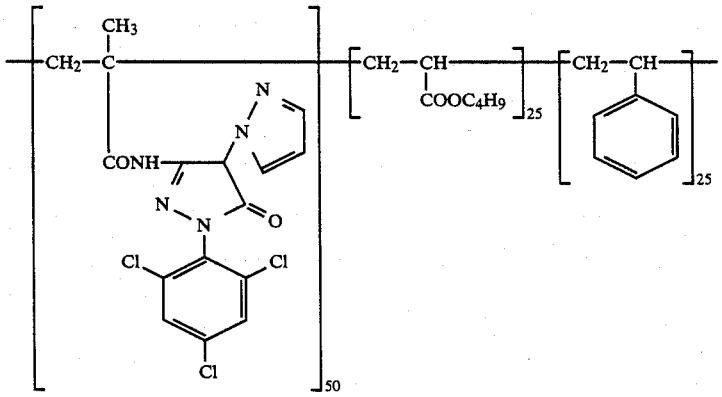
Average molecular weight: 30,000

-continued
EX-7
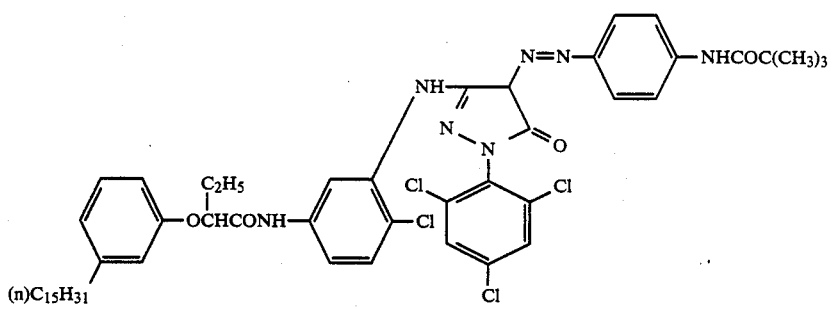
EX-8
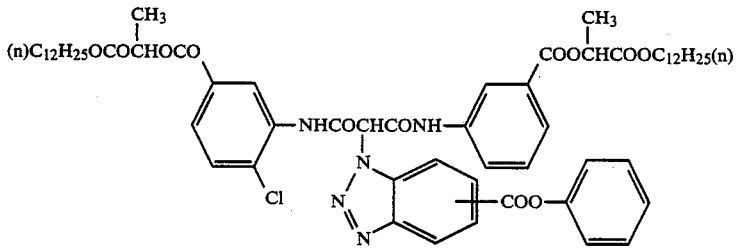
EX-9
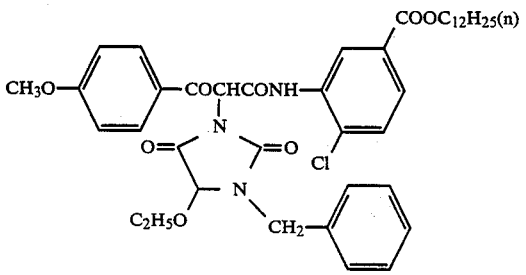
EX-10
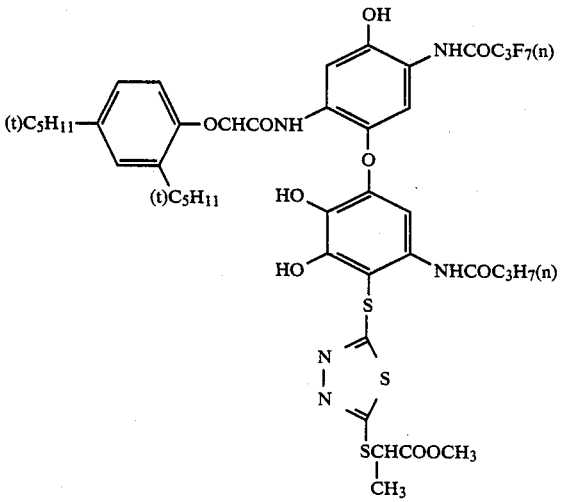

-continued
EX-11
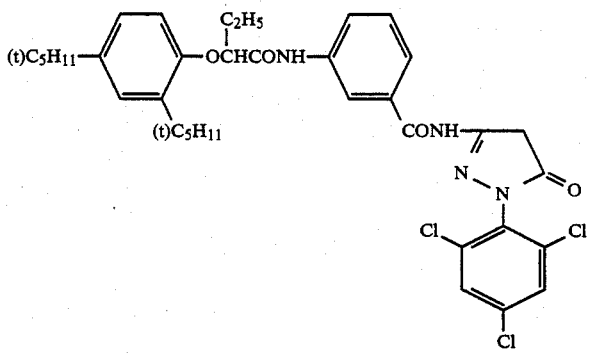
EX-12
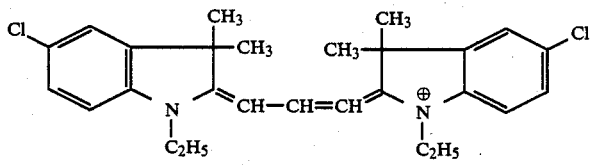
S-1
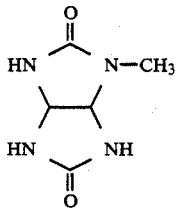
S-2
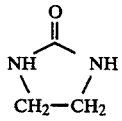
Tricresyl phosphate HBS-1
Dibutyl phthalate HBS-2
bis(2-Ethylhexyl)phthalate HBS-3
HBS-4
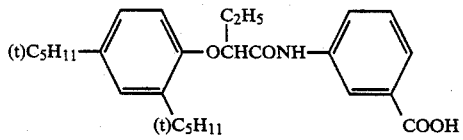
H-1
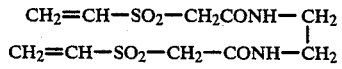
Sensitizing dye I
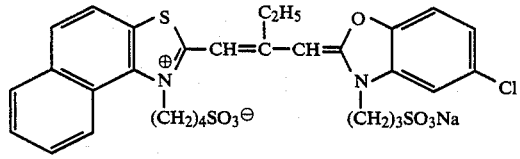
II
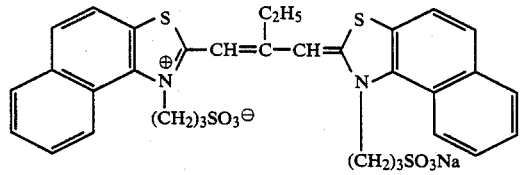

-continued

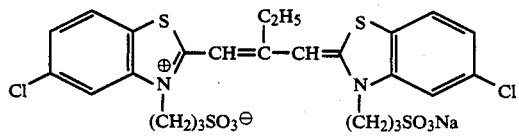

III

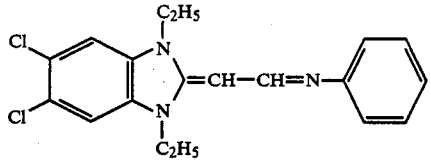

IV

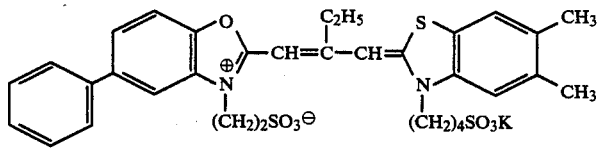

V

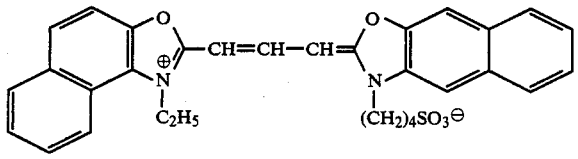

VI

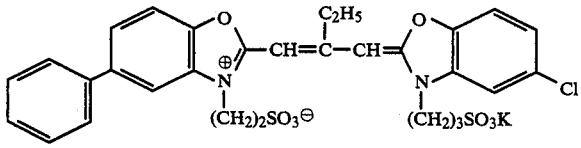

VII

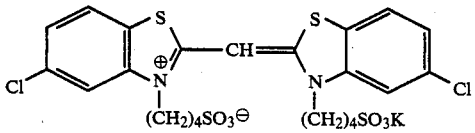

VIII

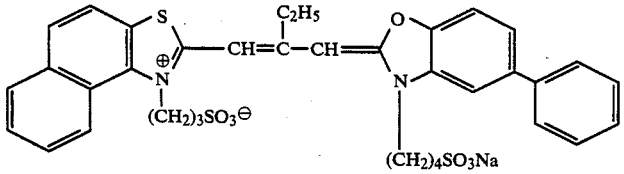

IX

Manufacture of Samples 302 to 304

Samples 302 to 304 were produced in the same way as Sample 301, except that instead of the black colloidal silver in the first layer in Sample 3-1, compounds of the present invention were added, giving the same optical density.

After cutting the individual samples to a width of 35 mm, a standard object was photographed and then the samples passed through the following treatment, this being carried out until the cumulative level of replenishment of the bleach fixing solution was three times the capacity of the mother liquid tank. Subsequently, Samples 301 to 304 were given a 20 CMS exposure using white light, and the developing treatment specified below was carried out. After developing, the level of residual silver in each sample was measured by the fluorescent X-ray method and the results are shown in Table 3.

Developing treatment method

| Process | Treatment Time | Temperature (°C.) |
|---|---|---|
| Color development | 3 min. 15 sec. | 38 |
| Bleaching | 1 min. 00 sec. | 38 |
| Blixing | 3 min. 15 sec. | 38 |
| Rinsing (1) | 40 sec. | 35 |
| Rinsing (2) | 1 min. 00 sec. | 35 |
| Stablizing | 40 sec. | 38 |
| Drying | 1 min. 15 sec. | 55 |

Composition of the treatment solutions

| Color Development Solution: | Mother Liquid | Replenishment |
|---|---|---|
| Diethylenetriaminepentaacetic acid | 1.0 g | 1.1 g |
| 1-Hydroxyethylidene-1,1-diphoshonic acid | 3.0 g | 3.2 g |

-continued

| | | |
|---|---|---|
| Sodium sulfite | 4.0 g | 4.4 g |
| Potassium carbonate | 30.0 g | 37.0 g |
| Potassium bromide | 1.4 g | 0.7 g |
| Potassium iodide | 1.5 mg | — |
| Hydroxylamine sulfate | 2.4 g | 2.8 g |
| 4-(N—Ethyl-N—β-hydroxy-ethylamino)-2-methyl-aniline sulfate | 4.5 g | 5.5 g |
| Water to make | 1.0 l | 1.0 l |
| pH | 10.05 | 10.10 |

| Bleaching Solution: Both mother liquid and replenisher | (units g) |
|---|---|
| Ferric ammonium ethylenediaminetetra-acetate dihydrate | 120 |
| Disodium ethylenediaminetriacetate | 10.0 |
| Ammonium bromide | 100.0 |
| Ammonium nitrate | 10.0 |
| Bleaching accelerator | 0.005 mol |

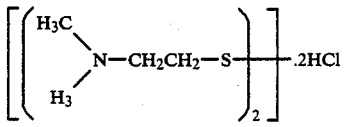

| | |
|---|---|
| Aqueous ammonia (27%) | 15.0 ml |
| Water to make | 1.0 l |
| pH | 6.3 |

| Blixing Solution: Both mother liquid and replenisher | (units g) |
|---|---|
| Ferric ammonium ethylenediaminetetra-acetate dihydrate | 50.00 |
| Disodium ethylenediaminetetraacetate | 5.0 |
| Sodium sulfite | 12.0 |
| Aqueous ammonium thiosulfate solution (70%) | 240.0 ml |
| Aqueous ammonia (27%) | 6.0 ml |
| Water to make | 1.0 l |
| pH | 7.2 |

Rinsing Liquid(Both mother liquid and replenisher)

Tap water was passed through a mixed-bed type column packed with an H-type strong acid cation exchange resin (Amberlite IR-120B, manufactured by Rohm and Haas) and an OH-type anion exchange resin (Amberlite IR-400, manufactured by Rohm and Haas), and the calcium and magnesium ion concentrations were reduced to below 3 mg per liter. Then, 20 mg per liter of sodium dichloroisocyanurate and 150 mg per liter of sodium sulfate, were added.

The pH of this liquid was in the range of 6.5 to 7.5.

Stabilizing Solution(Both mother liquid and replenisher)

| | |
|---|---|
| Formalin (37%) | 2.0 ml |
| Polyoxyethylene-p-monononyl phenyl ether (average degree of polymerization 10) | 0.3 |
| Disodium ethylenediaminetetraacetate | 0.05 |
| Water to make | 1.0 l |
| pH | 5.0–8.0 |

TABLE 3

| Sample | Compound | Residual Silver ($mg/m^2$) |
|---|---|---|
| 301 | Black colloidal silver | 51 |
| 302 | Leuco-dyestuff (17) + metal salt (1) | 23 |
| 303 | Leuco-dyestuff (18) + metal salt (2) | 25 |

TABLE 3-continued

| Sample | Compound | Residual Silver ($mg/m^2$) |
|---|---|---|
| 304 | Leuco-dyestuff (19) + metal salt (3) | 20 |

Sample 301 is a comparative sample.

Samples 302 to 304 are in accordance with the invention.

It is clear from the low values of the residual silver in Table 3 that the desilvering of Samples 302 to 304, where the compounds of the present invention were employed, was excellent.

Furthermore, after the imaging exposure of the samples, the aforesaid treatment was carried out, the cyan density measured, and then, after 24 hours irradiation with a Xe lamp the cyan density was remeasured. It was found that Samples 302 to 304, which employed the compounds of the present invention, had comparatively outstanding color image stability.

EXAMPLE 4

A color photographic light-sensitive material (Sample 401) was produced by the multilayer coating of the 1st to the 14th layers described below onto a triacetate base. Composition of the light-sensitive layer:

The components and the coverage expressed in units of $g/m^2$ of the layer are shown below. In the case of the silver halide, the coverage is based on conversion to silver.

| | |
|---|---|
| First Layer (Antihalation Layer) | |
| Black colloidal silver | 0.30 |
| Gelatin | 2.50 |
| UV-1 | 0.05 |
| UV-2 | 0.10 |
| UV-3 | 0.10 |
| Solv-1 | 0.10 |
| Second Layer (Intermediate Layer) | |
| Gelatin | 0.50 |
| Third Layer (Low-sensitive Red-sensitive Layer) | |
| Monodisperse silver iodobromide emulsion (AgI 4 mol %, cubic, average grain size 0.3 μm, s/r = 0.15) | 0.50 |
| ExS-1 | $1.40 \times 10^{-3}$ |
| ExS-2 | $6.00 \times 10^{-5}$ |
| Gelatin | 0.80 |
| ExC-1 | 0.20 |
| ExC-2 | 0.10 |
| Solv-2 | 0.10 |
| Fourth Layer (Medium-sensitivity Red-sensitive Layer) | |
| Monodisperse silver iodobromide emulsion (AgI 2.5 mol %, tetradecahedral, average grain size 0.45 μm, s/r = 0.15) | 0.50 |
| ExS-1 | $1.60 \times 10^{-3}$ |
| ExS-2 | $6.00 \times 10^{-5}$ |
| Gelatin | 1.00 |
| ExC-1 | 0.30 |
| ExC-2 | 0.15 |
| Solv-2 | 0.20 |
| Fifth Layer (High-sensitivity Red sensitive Layer) | |
| Monodisperse silver iodobromide emulsion (AgI 2.5 mol %, tetradecahedral, average grain size 0.60 μm, s/r = 0.15) | 0.30 |
| ExS-1 | $1.60 \times 10^{-3}$ |
| ExS-2 | $6.00 \times 10^{-5}$ |
| Gelatin | 0.70 |
| ExC-1 | 0.20 |
| ExC-2 | 0.10 |
| Solv-2 | 0.12 |
| Sixth Layer (Intermediate Layer) | |
| Gelatin | 1.0 |

-continued

| | |
|---|---|
| Cpd-1 | 0.1 |
| Solv-1 | 0.03 |
| Solv-2 | 0.08 |
| Solv-3 | 0.12 |
| Cpd-2 | 0.25 |
| Seventh Layer (Low-sensitivity Green-sensitive Layer) | |
| Silver iodobromide emulsion (AgI = 3.0 mol %, regular crystal, twin crystal mixture, average size 0.3 μm) | 0.65 |
| ExS-3 | $3.30 \times 10^{-3}$ |
| ExS-4 | $1.50 \times 10^{-3}$ |
| Gelatin | 1.50 |
| ExM-1 | 0.10 |
| ExM-2 | 0.25 |
| Solv-2 | 0.30 |
| Eighth Layer (High-sensitivity Green-sensitive Layer) | |
| Platelet silver iodobromide emulsion (AgI = 2.5 mol %, grains with a ratio of diameter:thickness of at least 5 comprise 50% of the projected area of the total grains, average grain thickness 0.15 μm) | 0.70 |
| ExS-3 | $1.30 \times 10^{-3}$ |
| ExS-4 | $5.00 \times 10^{-4}$ |
| Gelatin | 1.00 |
| ExM-3 | 0.25 |
| Cpd-3 | 0.10 |
| Cpd-4 | 0.05 |
| Solv-2 | 0.05 |
| Ninth Layer (Intermediate Layer) | |
| Gelatin | 0.50 |
| Tenth Layer (Yellow Filter Layer) | |
| Yellow colloidal silver | 0.10 |
| Gelatin | 1.00 |
| Cpd-1 | 0.05 |
| Solv-1 | 0.03 |

-continued

| | |
|---|---|
| Solv-2 | 0.07 |
| Cpd-2 | 0.10 |
| Eleventh Layer (Low-sensitivity Blue-sensitive Layer) | |
| Silver iodobromide emulsion (AgI = 2.5 mol %, regular crystal, twin crystal mixture, average grain size 0.7 μm) | 0.55 |
| ExS-5 | $1.00 \times 10^{-3}$ |
| Gelatin | 0.99 |
| ExY-1 | 0.50 |
| Solv-2 | 0.10 |
| Twelfth Layer (High-sensitivity Blue-sensitive Layer) | |
| Platelet silver iodobromide emulsion (AgI = 2.5 mol %, grains with a ratio of diameter:thickness of at least 5 constitute 50% of the projected area of the total grains, average grain thickness 0.13 μm) | 1.00 |
| ExS-5 | $1.70 \times 10^{-3}$ |
| Gelatin | 2.00 |
| ExY-1 | 1.00 |
| Solv-2 | 0.20 |
| Thirteenth Layer (Ultraviolet absorbing Layer) | |
| Gelatin | 1.50 |
| UV-1 | 0.02 |
| UV-2 | 0.04 |
| UV-3 | 0.04 |
| Cpd-5 | 0.30 |
| Solv-1 | 0.30 |
| Cpd-6 | 0.10 |
| Fourteenth Layer (Protective Layer) | |
| Fine grain silver iodobromide (silver iodide 1 mol %, average grain size 0.05 μm) | 0.10 |
| Gelatin | 2.00 |
| H-1 | 0.30 |

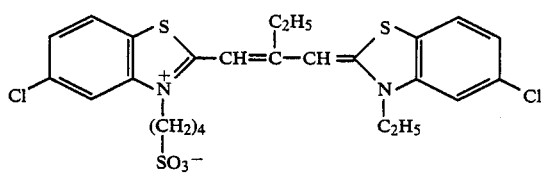

ExS-1

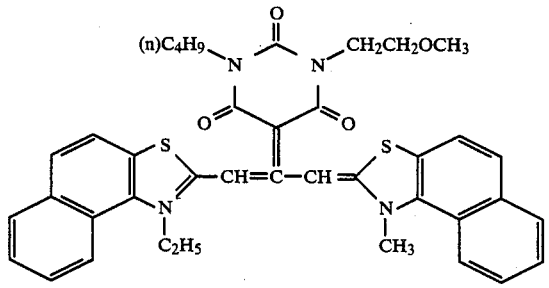

ExS-2

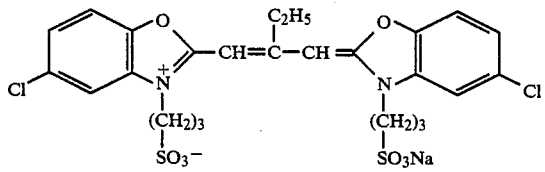

ExS-3

-continued
ExS-4
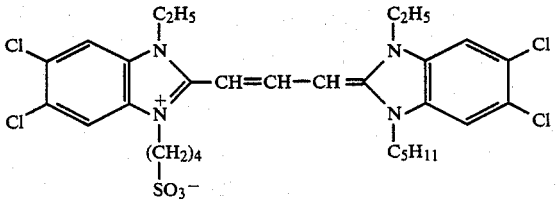
ExS-5
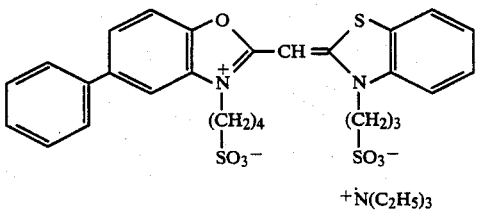
UV-1
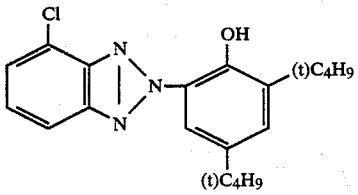
UV-2
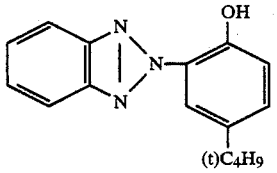
UV-3
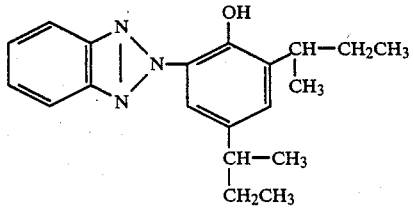
Cpd-1
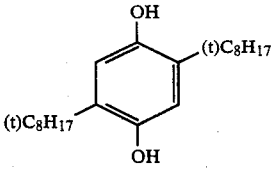
Polyethylacrylate Cpd-2
Cpd-3
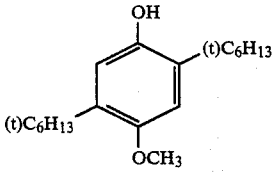
Cpd-4
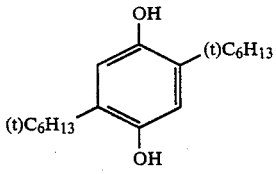

-continued
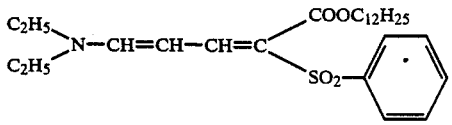
Cpd-5
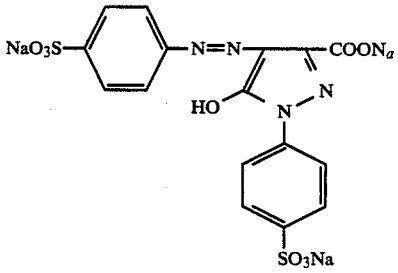
Cpd-6
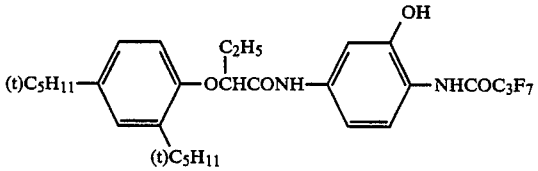
ExC-1
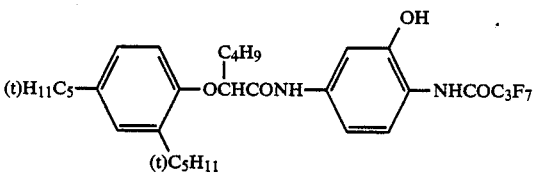
ExC-2
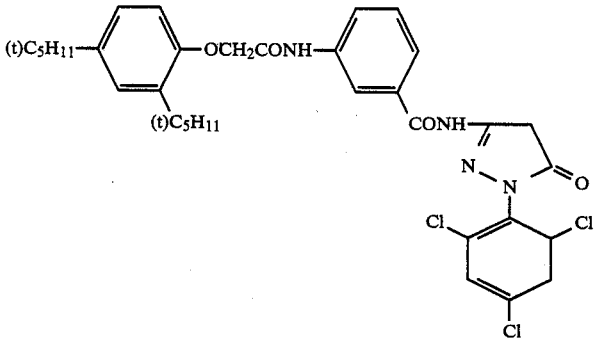
ExM-1
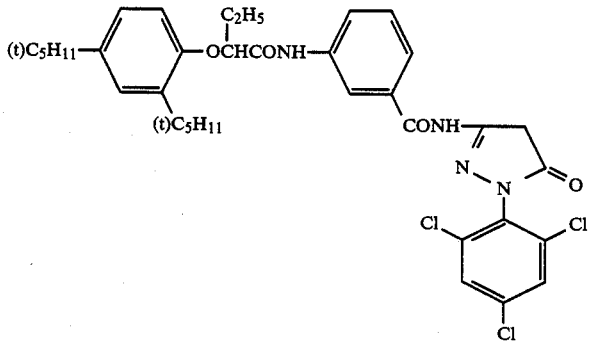
ExM-2

-continued

ExM-3

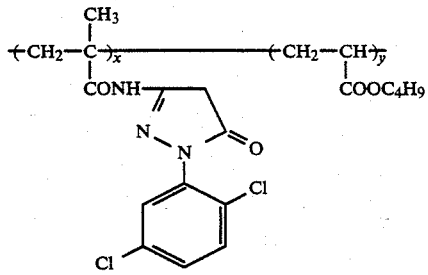

ExY-1

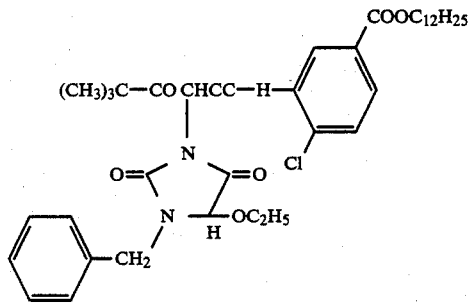

Solv-1; Dibutyl phthalate
Solv-2; Tricresyl phosphate
Solv-3; Trinonyl phosphate
H-1; 1,2-bis(vinylsulfonylacetamido)ethane

Manufacture of Sample 402

Sample 402 was produced in an identical manner to Sample 401, except that the yellow colloidal silver in the tenth layer of Sample 401, was replaced by 0.50 g/m$^2$ of a comparative dye of the structure given below.

Manufacture of Samples 403 to 407

Samples 403 to 407 were produced in an identical manner to Sample 401 except that the yellow colloidal silver in the tenth layer of Sample 401 was replaced by 0.40 g/m$^2$ of leuco-dyestuffs (5), (7), (8), (51) and (53) of the present invention plus either metal salt (1) or (4) (same molar quantity as the leuco-dyestuff).

After the imaging exposure of Sample 301 (sic) produced as described above, treatment was carried out by the method described below using an automatic developing machine until the cumulative replenishment of the first developing solution reached 3 times the tank capacity. Subsequently, aforesaid Samples 401 to 407 were given a red imaging exposure, and then a color development treatment was performed by the following reversal treatment process.

Comparative dye:

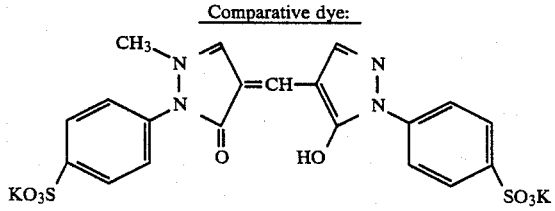

| Treatment Process | Time | Temp. (°C.) | Tank Capacity (l) | Replenishment (ml/m$^2$)) |
|---|---|---|---|---|
| 1st Developing | 6 min. | 38 | 12 | 2,200 |

-continued

| Treatment Process | Time | Temp. (°C.) | Tank Capacity (l) | Replenishment (ml/m$^2$)) |
|---|---|---|---|---|
| 1st Rinsing | 45 sec. | 38 | 2 | 2,200 |
| Reversal | 45 sec. | 38 | 2 | 1,100 |
| Color development | 6 min. | 38 | 12 | 2,200 |
| Bleaching | 2 min. | 38 | 4 | 860 |
| Blixing | 4 min. | 38 | 8 | 1,100 |
| Second rinse (1) | 1 min. | 38 | 2 | — |
| Second rinse (2) | 1 min. | 38 | 2 | 1,100 |
| Stabilizing | 1 min. | 25 | 2 | 1,100 |
| Drying | 1 min. | 65 | — | — |

The replenishment of the second rinse was carried out by a so-called countercurrent replenishment system, i.e., the replenishment liquid was led to second rinse (2) and then the overflow from this was led to second rinse (1).

The compositions of the various photographic processing treatment solutions were as follows:

| First Developing Solution | (Mother Liquid) | (Replenishment) |
|---|---|---|
| Nitrilo-N,N,N—trimethylenephosphonic acid pentasodium salt | 2.0 g | 2.0 g |
| Sodium sulfate | 30 g | 30 g |
| Potassium hydroquinone monosulfonate | 20 g | 20 g |
| Potassium carbonate | 33 g | 33 g |
| 1-Phenyl-4-methyl-4-hydroxymethyl-3-pyrazolidone | 2.0 g | 2.0 g |
| Potassium bromide | 2.5 g | 1.4 g |
| Potassium thiocyanate | 1.2 g | 1.2 g |
| Potassium iodide | 2.0 mg | |
| Water to make | 1,000 ml | 1,000 ml |
| pH | 9.60 | 9.60 |

The pH was adjusted with hydrochloric acid or potassium hydroxide.

| First Rinse Liquid | (Mother Liquid) | (Replenishment) |
|---|---|---|
| Ethylenediaminetetramethylene-phosphonic acid | 2.0 g | 2.0 g |
| Disodium phosphate | 5.0 g | 5.0 g |
| Water to make | 1,000 ml | 1,000 ml |
| pH | 7.00 | 7.00 |

The pH was adjusted with hydrochloric acid or sodium hydroxide.

| Reversal Solution | (Mother Liquid) | (Replenishment) |
|---|---|---|
| Nitrilo-N,N,N—trimethylene-phosphonic acid pentasodium salt | 3.0 g | 3.0 g |
| Stannous chloride dihydrate | 1.0 g | 1.0 g |
| p-Aminophenol | 0.1 g | 0.1 g |
| Sodium hydroxide | 8 g | 8 g |
| Glacial acetic acid | 15 ml | 15 ml |
| Water to make | 1,000 ml | 1,000 ml |
| pH | 6.00 | 6.00 |

The pH was adjusted with hydrochloric acid or sodium hydroxide.

| Color developing Solution | (Mother Liquid) | (Replenishment) |
|---|---|---|
| Nitrilo-N,N,N—trimethylene-phosphonic acid pentasodium salt | 2.0 g | 2.0 g |
| Sodium sulfite | 7.0 g | 7.0 g |
| Trisodium phosphate dodecahydrate | 36 g | 36 g |
| Potassium bromide | 1.0 g | |
| Potassium iodide | 90 mg | |
| Sodium hydroxide | 3.0 g | 3.0 g |
| Citrazinic acid | 1.5 g | 1.5 g |
| N—Ethyl-N—(methane sulfonamidoethyl)-3-methyl-4-aminoaniline sulfate | 11 g | 11 g |
| 3,6-Dithiooctane-1,8-diol | 1.0 g | 1.0 g |
| Water to make | 1,000 ml | 1,000 ml |
| pH | 11.80 | 12.00 |

The pH was adjusted with hydrochloric acid or potassium hydroxide.

| Bleaching Solution | (Mother Liquid) | (Replenishment) |
|---|---|---|
| Disodium ethylenediamine tetraacetate dihydrate | 10.0 g | Same as mother liquid |
| Fe(III) ammonium ethylene diaminetetraacetate dihydrate | 120 g | |
| Ammonium bromide | 100 g | |
| Ammonium nitrate | 10 g | |
| Bleaching accelerator | 0.005 ml | |

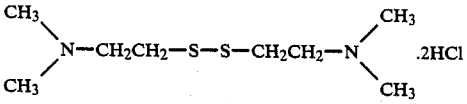

| | | |
|---|---|---|
| Water to make | 1,000 ml | |

-continued

| | |
|---|---|
| pH | 6.20 |

The pH was adjusted with hydrochloric acid or aqueous ammonia.

| Bleach-fixing Solution | (Mother Liquid) | (Replenishment) |
|---|---|---|
| Fe(II) ammonium ethylenediamine tetraacetate dihydrate | 50 g | 50 g |
| Disodium ethylenediamine tetraacetate dihydrate | 5.0 g | 5.0 g |
| Sodium thiosulfate | 80 g | 80 g |
| Sodium sulfite | 12.0 g | 12.0 g |
| Water to male | 1,000 ml | 1,000 ml |
| pH | 6.60 | 6.60 |

The pH was adjusted with hydrochloric acid or aqueous ammonia.

Second Rinse Liquid(Both mother liquid and replenisher)

Tap water was passed through a mixed-bed type column packed with a H-type strong acid cation exchange resin (Amberlite IR-120B, manufactured by Rohm and Haas) and an OH-type anion exchange resin (Amberlite IR-400, manufactured by Rohm and Haas), and the calcium and magnesium ion concentrations were reduced to 3 mg per liter or below, after which 20 mg per liter of sodium dichloroisocyanurate and 1.5 g per liter of sodium sulfate were added. The pH of this liquid was in the range of 6.5 to 7.5.

| Stabilizing Solution | (Mother Liquid) | (Replenishment) |
|---|---|---|
| Formalin (37%) | 5.0 ml | 5.0 ml |
| Polyoxyethylene-p-monononylphenylether (average degree of polymerization 10) | 0.5 ml | 0.5 ml |
| Water to make | 1,000 ml | 1,000 ml |
| pH | not adjusted | not adjusted |

The maximum yellow density (D1) was measured on these developed samples using a blue filter, and the results are shown in Table 4. Further, a 200 CMS exposure was given using white light and then the development treatment described below carried out, after which the minimum yellow density (D2) was measured. The results are shown in Table 4.

TABLE 4

| Sample | Compound | D1 | D2 |
|---|---|---|---|
| 401 | Yellow colloidal silver | 3.22 | 0.28 |
| 402 | Comparative dye | 3.37 | 0.24 |
| 403 | Leuco dye (5), metal salt (1) | 3.51 | 0.20 |
| 404 | Leuco dye (7), metal salt (1) | 3.53 | 0.23 |
| 405 | Leuco dye (8), metal salt (4) | 3.46 | 0.19 |
| 406 | Leuco dye (51), metal salt (4) | 3.54 | 0.22 |
| 407 | Leuco dye (53), metal salt (1) | 3.48 | 0.20 |

Samples 401 and 402 are comparative samples.

Samples 403 to 407 are in accordance with the invention.

It is be clear from Table 4 that Samples 403 to 407, which employ the present invention, have a high value of maximum yellow density (D1) in comparison to the comparative samples, and there is no lowering in density which has been thought hitherto to originate in the yellow colloidal silver. Since the value of D2 is low, it is also clear that there is no residual color following treatment. Further, the developing solution was not color-contaminated following treatment.

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive material comprising a support having thereon at least one colored layer, and said layer can be decolored or lightened upon photographic processing of said photographic light-sensitive material, wherein said colored layer is formed by a process comprising the step of:

color developing at least one colorless or light-colored leuco-dyestuff utilizing at least one metal salt of an organic acid.

2. A silver halide photographic light-sensitive material as claimed in claim 1, wherein said color developing step for forming said colored layer comprises the steps of:

mixing said leuco-dyestuff and said metal salt of an organic acid together to effect color development, and adding said developed leuco-dyestuff to a coating composition for said colored layer.

3. A silver halide photographic light-sensitive material as claimed in claim 2, wherein said mixing step of said process for forming said colored layer comprises the step of:

mixing said dyestuff and said metal salt in a solvent selected from the group consisting of high boiling point solvents, low boiling point solvents, mixtures of low boiling point solvents and high boiling point solvents, alkaline aqueous solvents and water-soluble organic solvents.

4. A silver halide photographic light-sensitive material as claimed in claim 1, wherein said color developing step for forming said colored layer comprises the step of:

adding said leuco-dyestuff and said metal salt of an organic acid separately to a coating composition for said colored layer to effect color development of said dyestuff in said coating composition.

5. A silver halide photographic light-sensitive material as claimed in claim 2, wherein during said process for forming said colored layer, said leuco-dyestuff is utilized in an amount of from 1 to $1\times10^3$ mg/m$^2$, and said metal salt is utilized in an amount of from 0.5 to 4 mole equivalents based on the amount of said leuco-dyestuff utilized.

6. A silver halide photographic light-sensitive material as claimed in claim 5, wherein during said process for forming said colored layer, said leuco-dyestuff is utilized in an amount of from 1 to $5\times10^2$ mg/m$^2$, and said metal salt is utilized in an amount of from 0.5 to 1.5 mole equivalents based on the amount of said leuco-dyestuff utilized.

7. A silver halide photographic light-sensitive material comprising a support having thereon at least one colored layer, said layer comprising a color developed colorless or light-colored leuco-dyestuff, wherein said layer can be decolored or lightened upon photographic processing of said photographic light-sensitive material.

8. A silver halide photographic light-sensitive material as claimed in claim 6, wherein said leuco-dyestuff is selected from the group consisting of leuco-dyestuffs which absorb in the visible region and leuco-dyestuffs which absorb in the near infrared region, and said metal salt is selected from the group consisting of metal salts of salicylic acid, metal salts of resins based on phenols/salicylic acid/formaldehyde, metal salts of o-sulfonamido benzoic acid, metal salts of phenol/formaldehyde resins, metal salts of thiocyanate and metal xanthogenate salts.

9. A silver halide photographic light-sensitive material as claimed in claim 8, wherein said leuco-dyestuffs which absorb in the visible region are selected from the group of structural classes consisting of diarylphthalide, fluoran, indolylphthalide, acylleucoazine, leucoauramine, spiropyrane, triarylmethane and chromene.

10. A silver halide photographic light-sensitive material as claimed in claim 9, wherein said metal of said metal salts comprises zinc.

* * * * *